United States Patent [19]

Kurematsu et al.

[11] Patent Number: 4,746,598

[45] Date of Patent: May 24, 1988

[54] PROCESSING OF COLOR PHOTOGRAPHIC MATERIAL UTILIZING A STABILIZING SOLUTION AFTER FIXING

[75] Inventors: Masayuki Kurematsu; Shigeharu Koboshi, both of Hino, Japan

[73] Assignee: Konishiroku Photo Industry Co., Ltd., Tokyo, Japan

[21] Appl. No.: 21,530

[22] Filed: Feb. 26, 1987

Related U.S. Application Data

[63] Continuation of Ser. No. 809,522, Dec. 16, 1985, abandoned.

[30] Foreign Application Priority Data

Dec. 21, 1984 [JP] Japan ..... 59-271327

[51] Int. Cl.[4] ..... G03C 7/40; G03C 5/24; G03C 11/00; G03C 7/26

[52] U.S. Cl. ..... 430/372; 430/428; 430/429; 430/432; 430/463; 430/551

[58] Field of Search ..... 430/372, 551, 428, 429, 430/432, 463

[56] References Cited

U.S. PATENT DOCUMENTS

| | | | |
|---|---|---|---|
| 3,247,127 | 3/1961 | Bailey | 430/522 |
| 3,540,887 | 11/1970 | Depoorfer et al. | 430/580 |
| 3,575,704 | 4/1971 | Salesin | 430/521 |
| 3,647,460 | 3/1972 | Hofman et al. | 430/372 |
| 3,653,905 | 4/1972 | Depoorter et al. | 430/552 |
| 4,362,813 | 12/1982 | Mihara et al. | 430/550 |
| 4,473,631 | 9/1984 | Hirai et al. | 430/372 |
| 4,567,134 | 1/1986 | Koboshi et al. | 430/372 |

FOREIGN PATENT DOCUMENTS 1373026 11/1974 United Kingdom .

*Primary Examiner*—Mukund J. Shah

*Attorney, Agent, or Firm*—Frishauf, Holtz, Goodman & Woodward

[57] ABSTRACT

A method of processing a light-sensitive silver halide color photographic material by processing a light-sensitive silver halide color photographic material wherein generation of stain can be suppressed at unexposed portions even when prolonged continuous processing is conducted and storage stability of the cyan dye under high temperature and high humidity is improved. The processing is carried out with a processing solution having fixing ability and subsequently processing the fixed material with a water washing-substitutive stabilizing solution substantially without carrying out washing with water, which comprises carrying out processing with a water washing-substitutive stabilizing solution in the presence of at least one of the compounds represented by the Formulae (I), (II), (II') and (II'') shown below:

Formula (I)

Formula (II)

Formula (II')

Formula (II'')

18 Claims, No Drawings

PROCESSING OF COLOR PHOTOGRAPHIC MATERIAL UTILIZING A STABILIZING SOLUTION AFTER FIXING

This application is a continuation of application Ser. No. 809,522, filed Dec. 16, 1985, now abandoned.

BACKGROUND OF THE INVENTION

This invention relates to a method of processing a light-sensitive silver halide color photographic material (hereinafter abbreviated as a light-sensitive material), particularly to a stabilizing processing method which performs substantially no water washing step subsequent to the desilverization step.

In recent years, in a photo-finisher which performs automatically and continuously the developing processing of a light-sensitive material, the problems of conservation of environment and water resource are of particularly important concern, and it has been desired that great amount of water to be used in the step of washing with water subsequent to fixing or bleach-fixing processing should be reduced or made zero. For this purpose, there have been proposed techniques in which direct stabilizing processing is conducted without washing with water after processing of fixing or bleach-fixing. For example, Japanese Unexamined Patent Publications Nos. 8542/1982, 132146/1982, 14834/1982, 18631/1983 disclose techniques to perform processing with stabilizing solutions containing isothiazoline derivatives, benzisothiazolilne derivatives, soluble iron complexes, polycarboxylic acids, organic phosphonic acids.

These techniques concern the methods for inhibition or prevention of the problems generated by the fixing components brought about by the light-sensitive material into the water washing-substitutive stabilizing solution (herein meant to be a stabilizing solution which may be used as a substitute for water washing), but any technique cannot be practically provided for use at a certain level or higher of the fixing components brought about, and a supplemental amount of the stabilizing solution is required to be used at a certain level or higher. Particularly, if the fixing component concentration in the final bath for the water washing-substitutive stabilizing solution is increased, there is involved the drawback that stability of the cyan dye under high temperature and high humidity is lowered due to increase of the residual chemicals in the light-sensitive material.

Also, when particularly the amount supplemented is lowered in the processing employing the water washing-substitutive stabilizing solution, the dye contained in the light-sensitive material is accumulated in the water washing-substitutive stabilizing solution to cause stain which is considered to be due to readhesion. The stain causes the white background to deteriorate particularly at the white background of the unexposed portion of a color printing paper, thus creating a serious drawback.

SUMMARY OF THE INVENTION

Accordingly, a first object of the present invention is to provide a method for processing a light-sensitive silver halide color photographic material without generation of stain at the unexposed portion even when a prolonged continuous processing is conducted with a water washing-substitutive stabilizing solution. A second object is to provide a method of processing a light-sensitive material after processing with a water washing-substitutive stabilizing solution which is improved in storage stability of the cyan dye under high temepraturе and high humidity.

The present inventors have made intensive studies to find that the above object can be accomplished by a method of processing a light-sensitive silver halide color photographic material by processing a light-sensitive silver halide color photographic material with a processing solution having a fixing ability and subsequently processing the fixed material with a water washing-substitutive stabilizing solution substantially without carrying out washing with water, which comprises carrying out processing with a water washing-substitutive stabilizing, in the presence of at least one of the compounds represented by the Formulae (I), (II), (II'), and (II'') shown below:

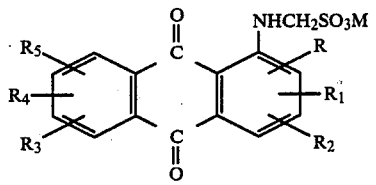

Formula (I)

wherein R, $R_1$, $R_2$, $R_3$, $R_4$ and $R_5$ each represent a hydrogen atom, a halogen atom, a hydroxy group, an alkyl group, an alkoxy group, a sulfo group or —$NHCH_2SO_3M$ (M represents a cation),

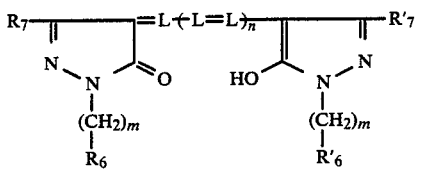

Formula (II)

wherein $R_6$ and $R_6'$ each represent a hydrogen atom, or an alkyl group, an aryl group or a heterocyclic group each of which optionally substitutes; $R_7$ and $R_7'$ each represent a hydroxy group, an alkoxy group, a substituted alkoxy group, a cyano group, a trifluoromethyl group, —$COOR_8$, —$CONHR_8$, —$NHCOR_8$, an amino group, a substituted amino group substituted with an alkyl group having 1 to 4 carbon atoms or a cyclic amino group represented by the Formula:

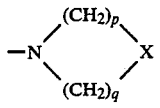

(wherein p and q each represent 1 or 2, and X represents an oxygen atom, a sulfur atom or a —$CH_2$— group); $R_8$ represents a hyrogen atom, an alkyl group or an aryl group; L represents a methyne group; n represents 0, 1 or 2; m represents 0 or 1, Formula (II')

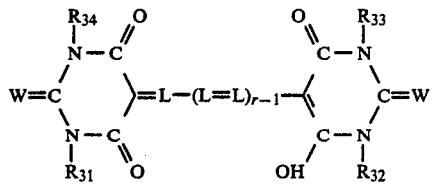

wherein r represents an integer of 1 to 3; W represents an oxygen atom or a sulfur atom; L represents a methyne group; $R_{31}$–$R_{34}$ each represent a hydrogen atom, an alkyl group, an aryl group, an aralkyl group or a heterocyclic group, at least one of which is a substituent other than hydrogen atom, Formula (II'')

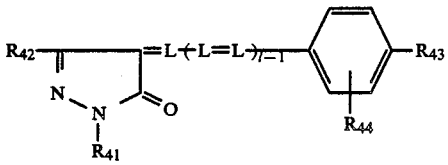

wherein l represents an integer of 1 or 2; L represents a methyne group; $R_{41}$ represents an alkyl group, an aryl group or a heterocyclic group; $R_{42}$ represents a hydroxy group, an alkyl group, an alkoxy group, a substituted alkoxy group, a cyano group, a trifluoromethyl group, —$COOR_8$, —$CONHR_8$, —$NHCOR_8$, an amino group, a substituted amino group substituted with an alkyl group having 1 to 4 carbon atoms or a cyclic amino group represented by the Formula:

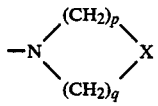

(wherein p and q each represent 1 or 2, and X represents an oxygen atom, a sulfur atom or a —$CH_2$— group); $R_8$ represents a hyrogen atom, an alkyl group or an aryl group; $R_{43}$ represents a —$OZ_1$ group or a

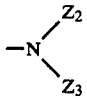

group; $Z_1$, $Z_2$ and $Z_3$ each represent a hydrogen atom or an alkyl group, $Z_2$ and $Z_3$ being either the same or different or alternatively being capable of bonding with each other to form a ring; and $R_{44}$ represents a hydrogen atom, an alkyl group, a chlorine atom or an alkoxy group.

As a further preferred embodiment, it has been found that the present invention can act effectively when the amount of the water washing-substitutive stabilizing solution supplemented is 25 ml to 500 ml per 1 $m^2$ of the light-sensitive silver halide color photographic material to be processed.

Further, the present inventors have found that the objects of the present invention can be accomplished more effectively when the pH of the stabilizing solution as substituted for washing water is 2 to 9.5, and also found that the objects of the present invention can be effectively accomplished particularly by the water washing-substitutive stabilizing solution which contains $10^{-5}$ mole or more of a compound which can release hydrogen ions after processing.

DESCRIPTION OF THE PREFERRED EMBODIMENTS

The present invention is to be described in detail below.

In the prior art when the final step is a water washing prosessing, the dye was washed away with a large amount of washing water. However, when stabilizing processing as substitute for water washing is used, the dye will be accumulated in the water washing-substitutive stabilizing solution partiuclarly when continuous processing is performed for a long term, whereby it has been found that stain is generated at the unexposed portion, which may be considered to be due to shortage in washing-out of the light-sensitive material or readhesion.

The present inventors have made intensive studies and consequently found that, when a compound of the Formula (I), (II), (II') or (II'') is used as the dye in the light-sensitive material, no stain is formed at the unexposed portion of the light-sensitive material even when the dye is dissolved out and accumulated in the water washing-substitutive stabilizing solution, and further that presence of a compound of the Formula (I), (II), (II') or (II'') can improve prevention cyan fading under high temperature and high humidity.

Thus, the effect of the compound of the present invention may be assumed to be due to not only absence of readhesion to the light-sensitive material, but also due to prevention of selective adsorption of unfavorable residual chemicals by the light-sensitive material.

Further, the present invention is based on the finding that the present invention can act very effectively when the amount of the water washing-substitutive stabilizing solution supplemented is 25 ml to 500 ml per 1 $m^2$ of the light-sensitive material, and also on a finding that the compound of the Formula (I), (II), (II') or (II'') of the present invention can act effectively when the pH value of the water washing-substitutive stabilizing solution is controlled to 2 to 9.5 and a compound capable of releasing hydrogen ions is contained in an amount of $10^{-5}$ mole or higher.

Although the effect of the present invention can be exhibited markedly when ammonium thiosulfate is the hydrogen ion releasing compound, the effect can also be exhibited by other additives to the stabilizing solution, provided that they are ammonium salts. These compounds may include ammonium 1-hydroxyethylidene-1,1-diphosphonate, ammonium ethylenediaminetetraacetate, etc.

The compound of the present invention should be preferably supplemented primarily through dissolving out from the light-sensitive material, but the amount of the stabilizing solution supplemented for that purpose should not exceed 500 ml per 1 $m^2$ of the light-sensitive material, while too small an amount is not also desirable, because the problem due to adhesion of the compound may be generated.

Next, the compounds represented by the above Formulae (I), (II), (II') and (II'') are to be described.

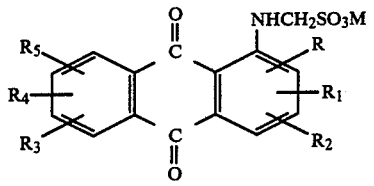

Formula (I)

wherein R, $R_1$, $R_2$, $R_3$, $R_4$ and $R_5$ each represent a hydrogen atom; a halogen atom (e.g. chlorine atom, bromine atom, fluorine atom); a hydroxy group; an alkyl group having 1 to 4 carbon atoms (e.g. methyl group, ethyl group, propyl group); an alkoxy group (e.g. methoxy group, ethoxy group, propoxy group); $—SO_3M$; or $—NHCH_2SO_3M$ where M represents a cation and may be an alkali metal (e.g. sodium atom, potassium atom); ammonium or an organic ammonium salt (e.g. pyridinium, piperidinium, triethyl-ammonium, triethanolamine, etc.).

Typical examples of the compounds represented by the above Formula (I) are shown below, by which the present invention is not limited.

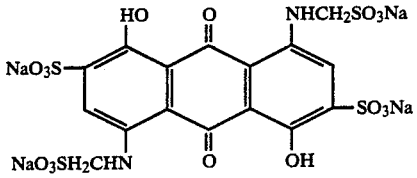

(A-1)

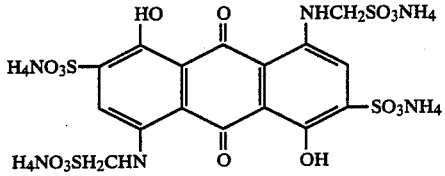

(A-2)

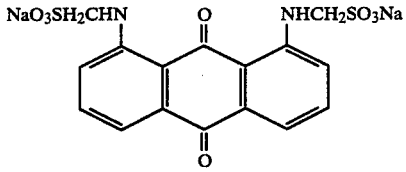

(A-3)

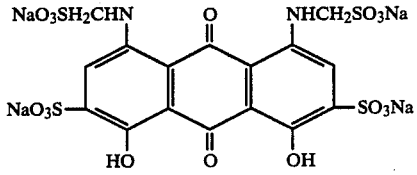

(A-4)

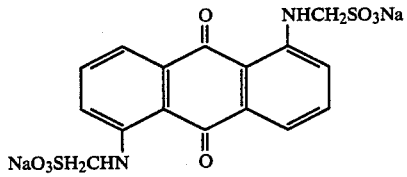

(A-5)

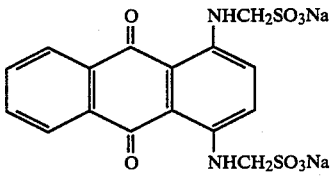

(A-6)

-continued

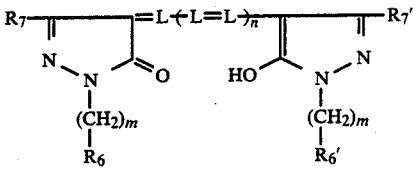

Formula (II)

In the Formula, each of $R_6$ and $R_6'$ represents a hydrogen atom, or an alkyl group, an aryl group or a heterocyclic group each of which may be substituted. The aryl group may include 4-sulfophenyl group, 4-(δ-sulfobutyl)phenyl group, 3-sulfophenyl group, 2,5-disulfophenyl group, 3,5-disulfophenyl group, 6,8-disulfo-2-naphthyl group, 4,8-disulfo-2-naphthyl group, 3,5-dicarboxyphenyl group, 4-carboxyphenyl group and the like, and such an aryl group can have a sulfo group, a sulfoalkyl group, a carboxyl group, an alkyl group having 1 to 5 carbon atoms (e.g. methyl, ethyl, etc.), a halogen atom (e.g. chlorine atom, bromine atom, etc.), an alkoxy group having 1 to 4 carbon atoms (e.g. methoxy, ethoxy, etc.) or a phenoxy group, etc.

The sulfo group may be bonded to the aryl group through a divalent organic group, as exemplified by 4-(4-sulfophenoxy)phenyl group, 4-(2-sulfoethyl)phenyl group, 3-(sulfomethylamino)phenyl group, 4-(2-sulfoethoxy)phenyl group, etc.

The alkyl group represented by $R_6$, $R_6'$ may be either straight, branched or cyclic, preferably one having 1 to 4 carbon atoms, such as ethyl, β-sulfoethyl, etc.

The heterocyclic group may include, for example, 2-(6-sulfo)benzthiazolyl group, 2-(6-sulfo)benzoxazolyl group and the like, which may also have a substituent such as a a halogen atom (e.g. fluorine atom, chlorine atom, bromine atom, etc.), an alkyl group (e.g. methyl, ethyl, etc.), an aryl group (e.g. a phenyl group, etc.), a carboxyl group, a sulfo group, a hydroxy group, an alkoxy group (e.g. methoxy, etc.), an aryoxy group (e.g. a phenoxy group, etc.), and so on.

Each of $R_7$ and $R_7'$ represents a hydroxy group; an alkoxy group having 1 to 4 carbon atoms (e.g. methoxy, ethoxy, isopropoxy, n-butyloxy); a substituted alkoxy group such as an alkoxy group having 1 to 4 carbon atoms substituted with a halogen atom or an alkoxy group having up to 2 carbon atoms (e.g. β-chloroethoxy, β-methoxyethoxy, etc.); a cyano group; a trifluoromethyl group; $—COOR_8$; $—CONHR_8$; $—NHCOR_8$ ($R_8$ represents a hydrogen atom; an alkyl group having 1 to 4 carbon atoms; or an aryl group such as phenyl, naphthyl, said alkyl group and aryl group optionally having a sulfo group or a carboxy group as the substituent); an amino group; a substituted amino group substituted with an alkyl group having 1 to 4 carbon atoms (e.g. ethylamino, dimethylamino, diethylamino, di-n-butylamino); or a cyclic amino group represented by

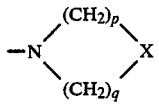

(where p and q each represent an integer of 1 or 2, X represents an oxygen atom, a sulfur atom or $—CH_2—$ group (e.g. morpholino, piperizino, piperazino).

The methyne group represented by L may be substituted with an alkyl group having 1 to 4 carbon atoms (e.g. methyl, ethyl, isopropyl, t-butyl, etc.) or an aryl group (e.g. phenyl, tolyl, etc.).

Also, at least one of the sulfo group, the sulfoalkyl group and the carboxy group may form a salt with an alkali metal (e.g. sodium, potassium), an alkaline earth metal (e.g. calcium, magnesium), ammonia or an organic base (e.g. diethylamine, triethylamine, morpholine, pyridine, piperidine, etc.). The symbol n represents 0, 1 or 2, while m represents 0 or 1.

In the compounds represented by Formula (II), the alkyl group or the aryl group for $R_6$, $R'_6$, $R_7$, or $R_8$ has preferably a carbonyl group or a sulfo group.

Typical examples of the compounds represented by the above Formula (II) are shown below, but the present invention is not limited thereto.

Exemplary compounds:

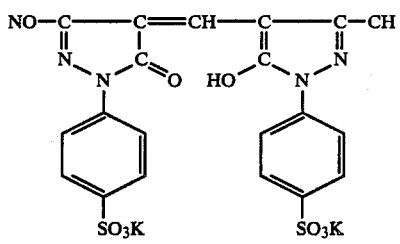
(B-1)

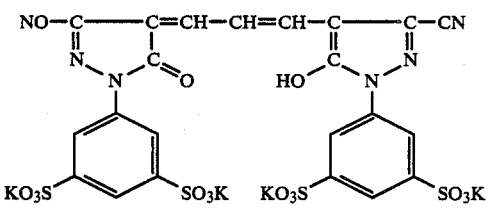
(B-2)

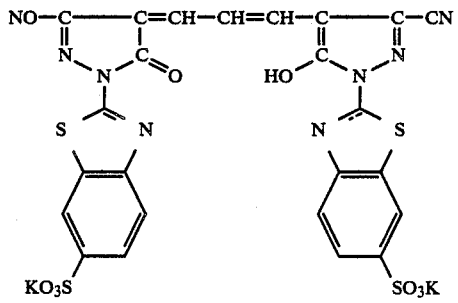
(B-3)

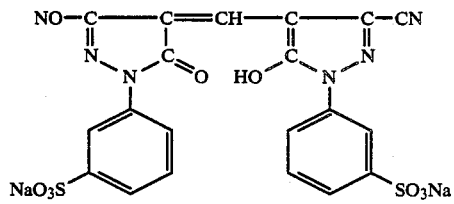
(B-4)

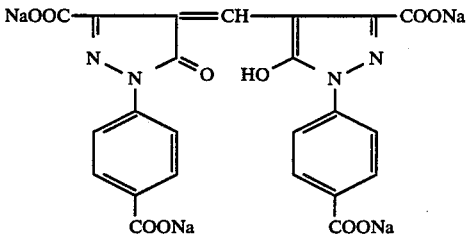
(B-5)

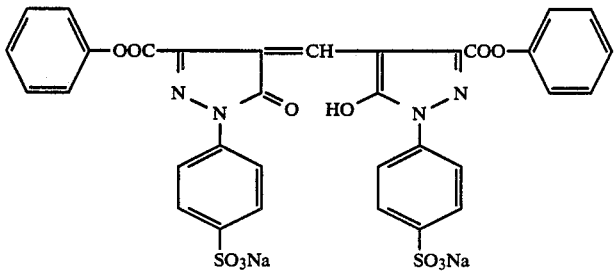
(B-6)

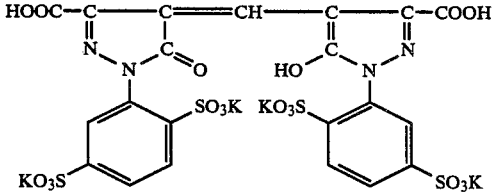
(B-7)

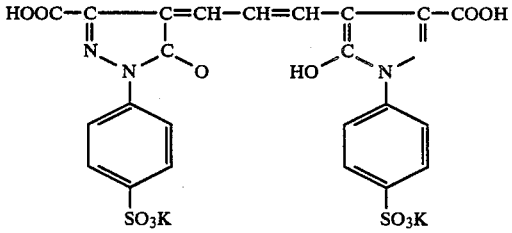
(B-8)

-continued
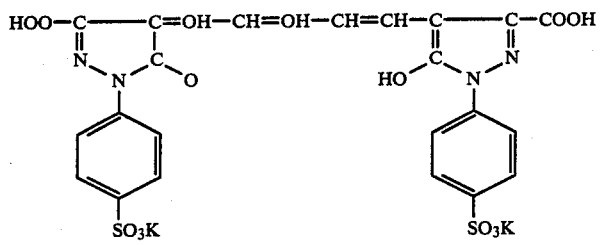
(B-9)
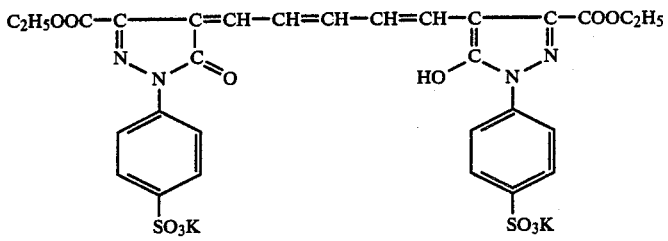
(B-10)
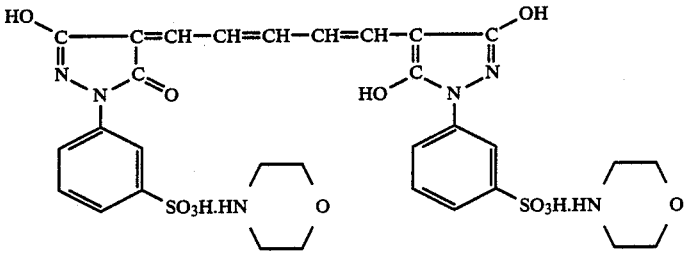
(B-11)
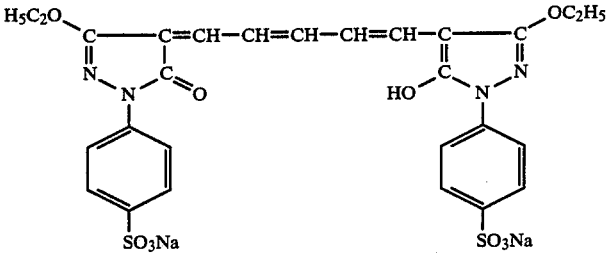
(B-12)
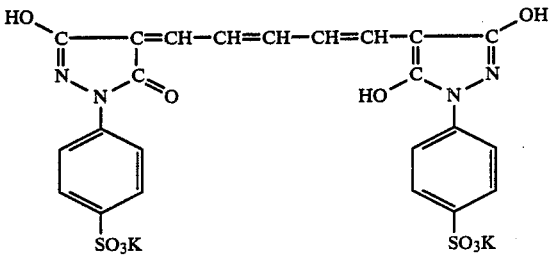
(B-13)
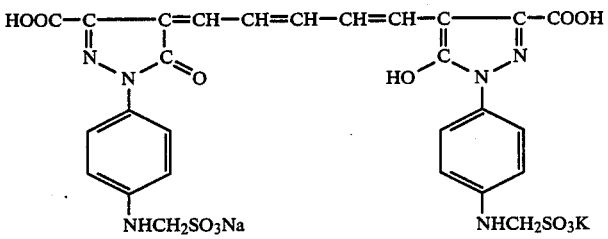
(B-14)

-continued
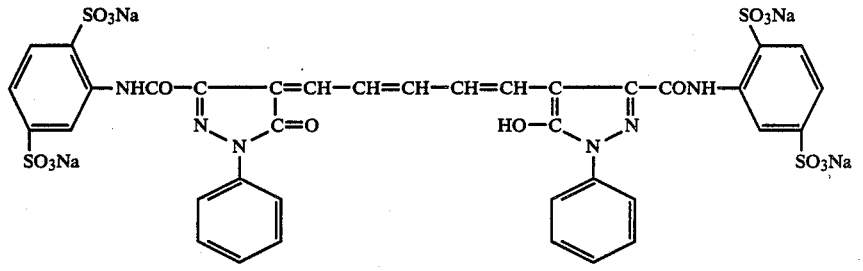
(B-15)
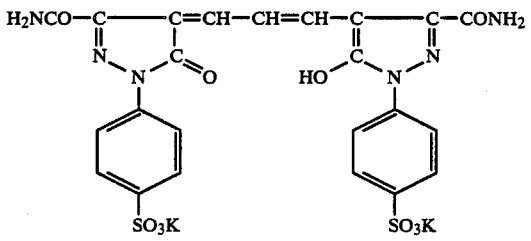
(B-16)
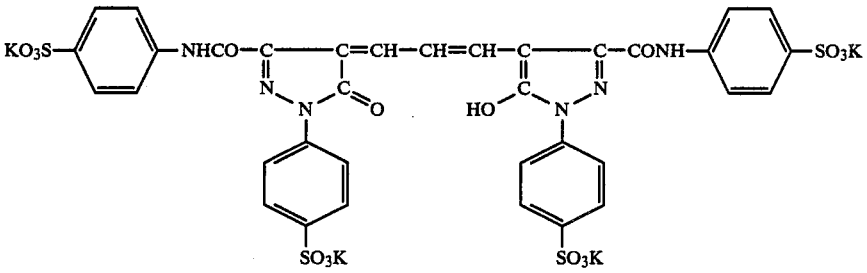
(B-17)
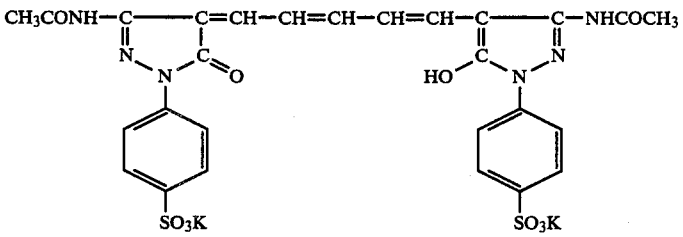
(B-18)
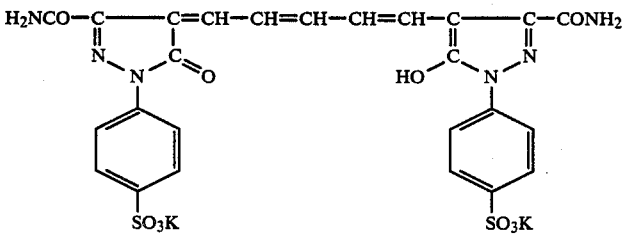
(B-19)
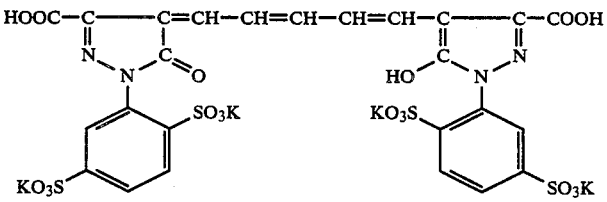
(B-20)

-continued
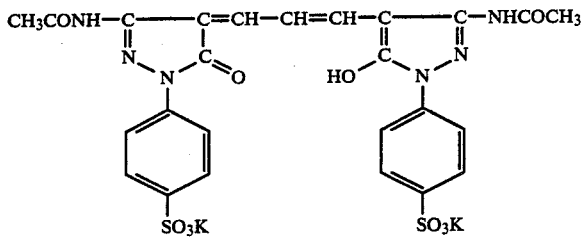
(B-21)
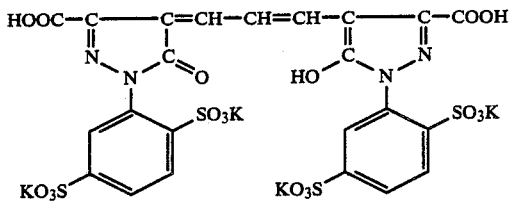
(B-22)
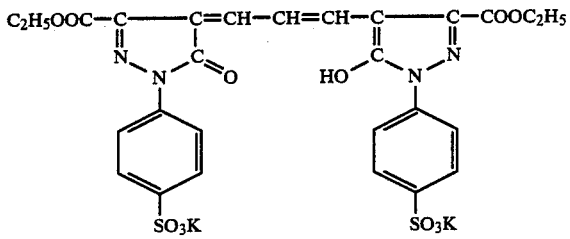
(B-23)
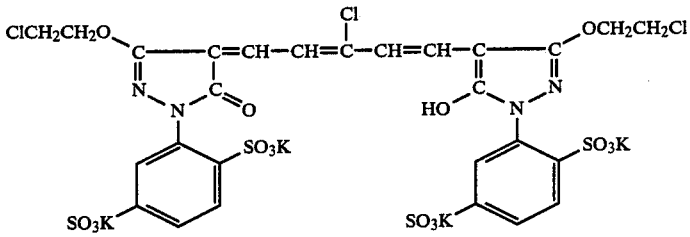
(B-24)
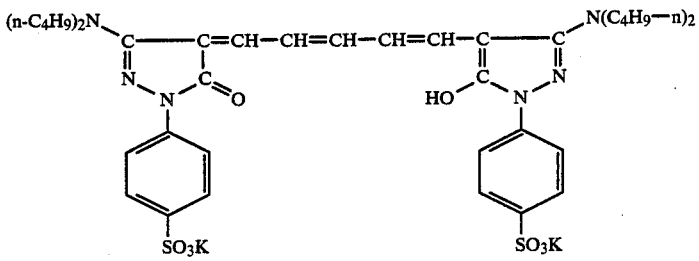
(B-25)
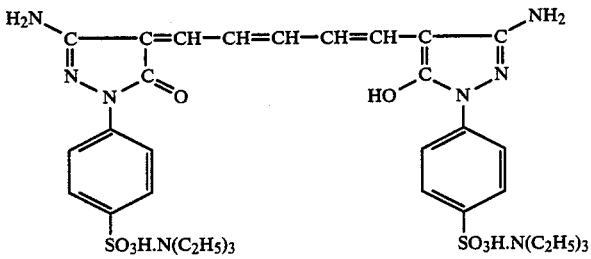
(B-26)

-continued (B-27)

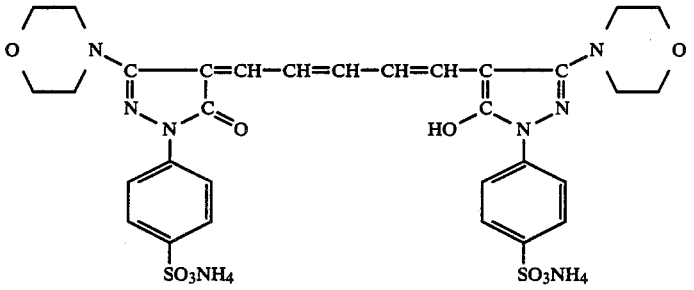

(B-28)

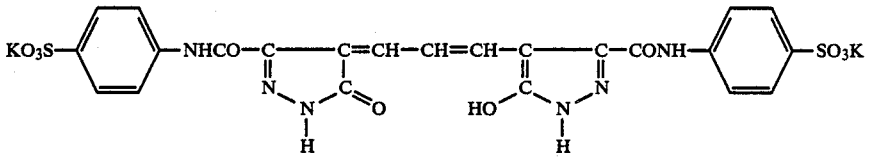

(B-29)

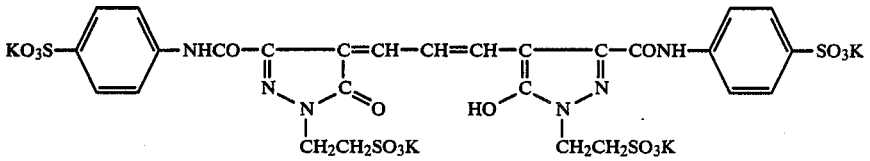

Formula (II')

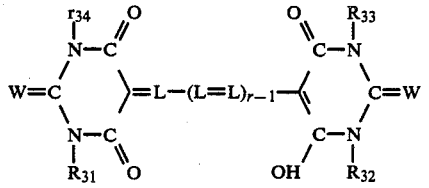

wherein r represents an integer of 1 to 3, W represents an oxygen atom or a sulfur atom, L represents a methyne group, $R_{31}$ to $R_{34}$ each represent a hydrogen atom, an alkyl group, an aryl group, an aralkyl group, a heterocyclic group, at least of which being substituents other than hydrogen atom.

The methyne group represented by L may include those as described above in the item of the Formula (II).

The alkyl group represented by $R_{31}$–$R_{34}$ may include the same as the alkyl group of $R_6$ and $R_6'$ described above in the item of the Formula (II), and the alkyl group may have a substituent. The substituent may include various substituents to be introduced into the group of $R_6$ and $R_6'$ in the item of Formula (II), preferably sulfo, carboxy, hydroxy, alkoxy, alkoxycarbonyl, cyanol, sulfonyl group.

The aryl group represented by $R_{31}$ to $R_{34}$ may preferably be a phenyl group, and the substituent to be introduced into the phenyl group may include various substituents as mentioned as the substituent to be introduced into $R_6$ and $R_6'$ in the item of the Formula (II), but it is preferred that the aromatic nucleus should have at least one of sulfo group, carboxy group and sulfamoyl group thereon.

The aralkyl group represented by $R_{31}$ to $R_{34}$ may preferably be a benzyl group or a phenethyl group, and the substituent to be introduced onto such an aromatic nucleus may include those as described above for the substituent of the aryl group of $R_{31}$ to $R_{34}$.

The hetercyclic group represented by $R_{31}$ to $R_{34}$ may include, for example, pyridyl, pyrimidyl, etc., and the substituent to be introduced onto such a heterocyclic ring may include those as described above for the substituent of the aryl group of $R_{31}$ to $R_{34}$.

The group represented by $R_{31}$ to $R_{34}$ may preferably be an alkyl group and an aryl group, and further it is desirable to have at least one group of carboxy, sulfo, sulfamoyl within the molecule of barbituric acid and thiobarbituric acid represented by the Formula (II'), and a symmetric type compound is preferred.

In the compounds represented by Formula (II'), the alkyl group or the aryl group for $R_{31}$, $R_{32}$, $R_{33}$ or $R_{34}$ has preferably a carbonyl group or a sulfo group.

In the following, specific examples of the compounds of the above Formula (II') are shown, but the present invention is not limited thereto.

(C-1)

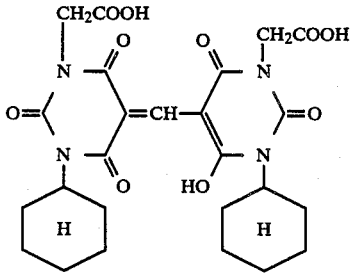

-continued (C-2)

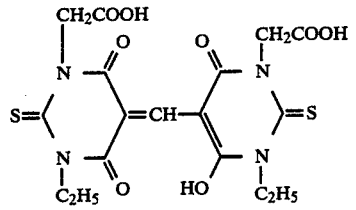

(C-3)

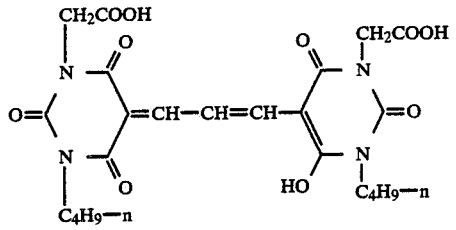

(C-4)

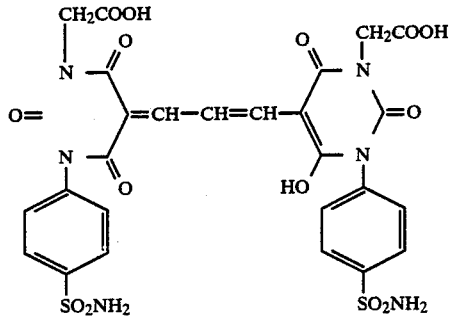

(C-5)

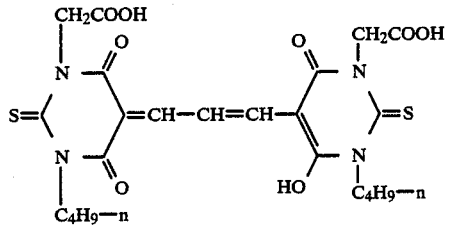

(C-6)

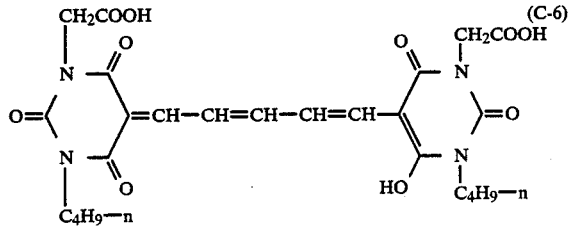

(C-7)

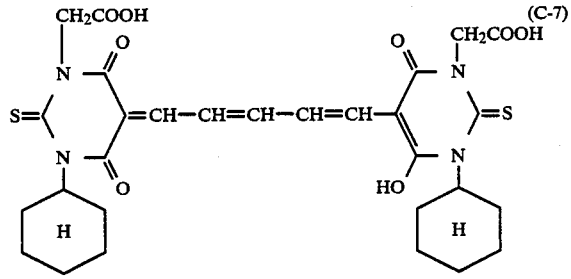

-continued

Formula (II'')

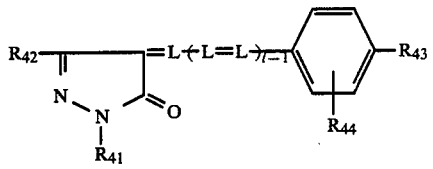

In the Formula, l represents an integer of 1 or 2, L represents a methyne group, $R_{41}$ has the same meaning as $R_6$ and $R_6'$ in the Formula (II), being preferably an alkyl group and an aryl group, said aryl group having desirably at least one sulfo group.

$R_{42}$ can introduce any of the substituents as shown for $R_7$ and $R_7'$ in the Formula (II), selected preferably from alkyl group, carboxy group, alkoxycarbonyl group, carbamoyl group, ureido group, acylamino group, imide group and cyano group.

$R_{43}$ represents —$OZ_1$ group or

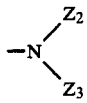

group, where $Z_1$, $Z_2$ and $Z_3$ each represent a hydrogen atom or an alkyl group, $Z_2$ and $Z_3$ being either the same or different, or alternatively bonded to each other to form a ring.

The alkyl group represented by $Z_1$, $Z_2$ and $Z_3$ may include, for example, methyl group, ethyl group, butyl group, hydroxyalkyl group (e.g. hydroxyethyl), alkoxyalkyl group (e.g. β-ethoxyethyl, etc.), caroxyalkyl group (e.g. β-carboxyethyl, etc.), alkoxycarbonyl alkyl group (e.g. β-ethoxycarbonylethyl, etc.), cyanoalkyl group (e.g. β-cyanoethyl group, etc.), sulfoalkyl group (e.g. β-sulfoethyl, γ-sulfopropyl, etc.) and the like.

$Z_2$ and $Z_3$ may be bonded to each other to form a 5- or 6-membered ring, as exemplified by morpholino group, piperizino group, pyrrolidino group, etc.

$R_{44}$ represents a hydrogen atom, an alkyl group, a chlorine atom or an alkoxy group. The alkyl group may be, for example, methyl, ethyl, etc., and the alkoxy group may be, for example, methoxy, ethoxy, etc.

In the compounds represented by Formula (II''), the alkyl groups or the arkyl groups for $R_{41}$, $R_{42}$, $R_{43}$ or $R_{44}$ has preferably a carbonyl group or a sulfo group.

In the following, specific examples of the compounds of the Formula (II'') are shown, but the present invention is not limited thereto.

(D-1)

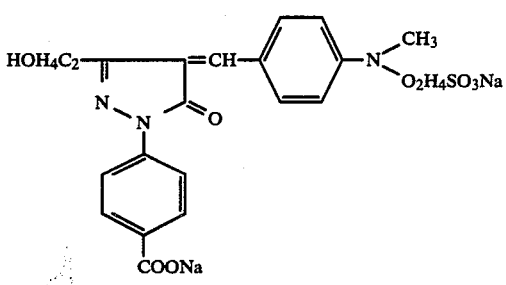

(D-2)

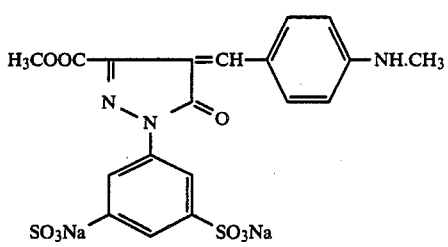

(D-3)

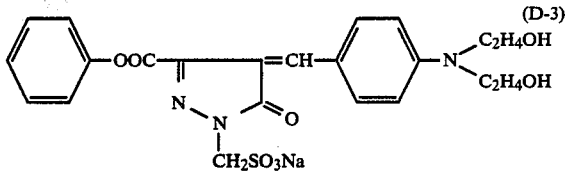

(D-4)

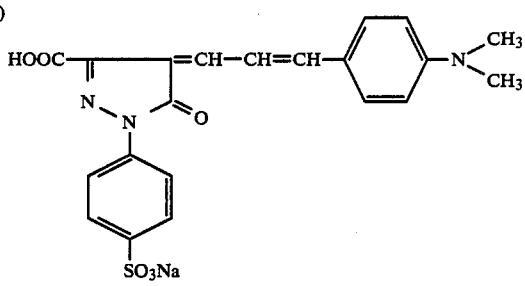

(D-5)

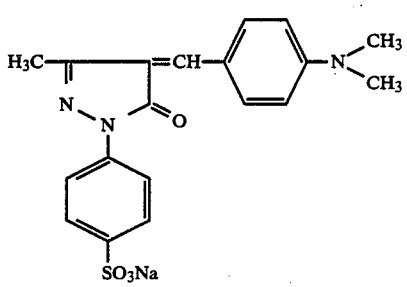

(D-6)

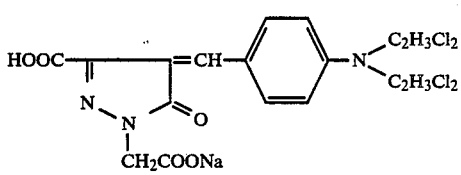

(D-7)

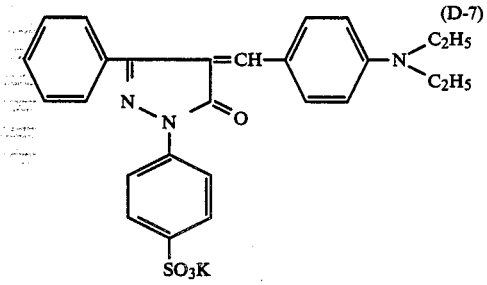

(D-8)

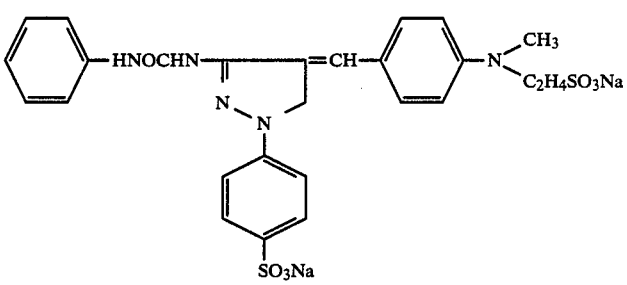

The compounds of the above Formula (I), (II), (II') or (II'') can be synthesized according to the synthetic methods as described in U.S. Pat. Nos. 3,575,704, 3,247,127, 3,540,887, 3,653,905, Japanese Unexamined Patent Publication Nos. 85130/1973, 99620/1974, 111640/1984, 111641/1984 and 170838/1984.

For processing with a water washing-substitutive stabilizing solution by permitting a compound of the Formula (I), (II), (II') or (II'') to be presented therein, the compound can be added directly to the water washing-substitutive stabilizing solution, or alternatively it can be added into the previous bath to be attached on the light-sensitive material and brought into the stabilizing bath. Further, it is practically preferred to incorporate it in the light-sensitive material, thereby permitting it to exist in the stabilizing solution. When it is to be incorporated in the light-sensitive material, it can be contained in either layer of a silver halide emulsion layer or otherwise hydrophilic colloid layer. Thus, an organic or inorganic alkali salt of the above compound of the present invention is dissolved in water to prepare an aqueous dye solution with an appropriate concentration, which is then added to the coating solution and applied in a conventional manner to be incorporated in the photographic material. The content of these compounds of the present invention may be controlled to 1 to 800 mg, preferably 2 to 200 mg, per $m^2$ of the light-sensitive material. When it is to be added into the water washing-substitutive stabilizing solution, its content should preferably be 0.005 to 200 mg per liter of the solution, particularly 0.01 to 50 mg.

Of the compounds represented by the above Formula (I), (II), (II') or (II''), those represented by the Formula (II) are more preferable. Also, these compounds may be used in a combination of two or more compounds.

When employing the method of incorporating the compound of the Formula (I), (II), (II') or (II'') of the present invention in the light-sensitive material and permitting it to be dissolved out into the water washing-substitutive stabilizing solution, its concentration dissolved out will of course determined depending on the amount supplemented of the water washing-substitutive stabilizing solution per unit area of the photographic material, but it is also related to the processing time and the processing temperature of the pre-processing before the stabilizing processing as substitute for water washing, namely processing with a color developing solution and a bleach-fixing solution.

When the processing time is longer and the processing temperature is higher for color developing and bleach-fixing solutions, the compound of the present invention will be previously dissolved out to a disadvantage. Accordingly, the time for pre-processing before stabilizing processing should be within 8 minutes, desirably within 6 minutes, most preferably within 4 minutes and 30 seconds. The processing temperature should preferably be 50° C. or lower. As to the amount supplemented of the processing solutions in carrying out continuous processing, the total amount supplemented in the color developing step and the bleach-fixing step before the stabilizing processing for substituting water washing should preferably be one liter or less per $m^2$ of the light-sensitive material, more preferably 600 ml or less. The amount supplemented of the water washing-substitutive stabilizing solution should preferably 2 liters or less, more preferably one liter or less, most preferably 500 ml or less, per $m^2$ of the light-sensitive material.

When the compound of the Formula (I), (II), (II') or (II'') is incorporated in the light-sensitive material, the amount of the compound of the above Formula (I), (II), (II') or (II'') dissolved out in the water washing-substitutive stabilizing solution will be such corresponding to the same concentration as in the case of being added directly to the water washing-substitutive stabilizing solution, depending on the processing temperature, time and the amount supplemented as described above.

When the compound of the above Formula (I), (II), (II') or (II'') is added into the water washing-substitutive stabilizing solution, the above-mentioned processing time and supplemental amount pose no problem at all, and such a method is preferred from the standpoint of pollution and rapid processing.

The processing step with a processing solution having fixing ability in the present invention refers to a step with the use of a fixing bath or a bleach-fixing bath intended to fixing of a light-sensitive material, which is ordinarily conducted after developing. The details about the processing solution having said fixing ability are described hereinbelow.

In the present invention, processing with a processing solution followed subsequently by substantially no water washing means that rinsing processing, or processing with auxiliary washing water and water washing promoting bath within a very short time by use of a single bath or a multi-tank countercurrent system may be possible, provided that the concentration of the fixing solution or bleach-fixing solution brought into the earliest tank for stabilizing processing will not become about 1/200-fold or less in said tank.

In the present invention, processing with a water washing-substitutive stabilizing solution refers to a processing for stabilizing processing by performing stabilizing processing immediately after processing with a processing solution having fixing ability substantially without carrying out water washing processing, the processing solution to be used for said stabilizing solution being referred to as the water washing-substitutive stabilizing solution and the processing tank as the stabilizing bath or stabilizing tank.

In the present invention, stabilizing processing can be carried out by use of one tank or multiple tanks without any problem, but preferably with the use of 1 to 4 tanks. Stabilizing processing may be carried out at a temperature ranging from 15° C. to 60° C., preferably from 20° C. to 45° C. The processing time should also be as short as possible from the viewpoint of rapid processing, but usually from 20 seconds to 10 minutes, most preferably from one minute to 5 minutes, with the processing time being preferably shorter for the tanks of earlier stages while longer for the tanks of later stages. Particularly, it is desirable to perform successive processing within a processing time increased by 20% to 50% as compared with that for the previous tank. Although no water washing processing is required at all after the stabilizing processing of the present invention, rinsing or surface washing with a small amount of water within a very short time may be performed as desired, if necessary.

The water washing-substitutive stabilizing solution in the stabilizing processing step according to the present invention may be fed, when the multi-tank countercurrent system is employed, preferably according to the method in which it is fed to the later bath and permitted to be overflowed from the earlier bath. The compound capable of releasing hydrogen ions after processing to be preferably used in the present invention has the effect of lowering the pH value of the emulsion film surface after drying by 0.5 or more as compared with the pH value of the water washing-substitutive stabilizing solution by addition to the stabilizing solution as substituted for washing water. Specific substances may include ammonium ion, methylamine, ethylamine, dimethylamine, trimethylamine, diethylamine, etc., salts thereof and compounds capable of releasing these. Among them, preferred are ammonium ion and ammonium compounds capable of releasing ammonium ions in aqueous solutions. More specifically, there may be employed, for example, ammonia water, ammonium bromide, ammonium, carbonate, ammonium chloride, ammonium hypophosphite, ammonium thiosulfate, ammonium sulfite, ammonium ethylenediaminetetraacetate, ferric ammonium diethylenetriaminepentaacetate, ferric ammonium ethylenediaminetetraacetate, ammonium diethylenetriaminepentaacetate, ammonium 1-hydroxyethylidene-1,1-diphosphonate, ammonium phosphate, ammonium phosphite, ammonium fluoride, acidic ammonium fluoride, ammonium fluoroborate, ammonium arsenate, ammonium hydrogen carbonate, ammoium hydrofluoride, ammonium hydrogen sulfate, ammonium sulfate, ammonium iodide, ammonium nitrate, ammonium pentaborate, ammonium acetate, ammonium adipate, ammonium laurintricarboxylate, ammonium benzoate, ammonium carbamate, ammonium citrate, ammonium diethyldithiocarbamate, ammonium formate, ammonium hydrogen malate, ammonium hydrogen oxalate, ammonium hydrogen phthalate, ammonium hydrogen tartarate, ammonium lactate, ammonium malate, ammonium phthalate, ammonium picrate, ammonium pyrrolidinedithiocarbamate, ammonium salicylate, ammonium succinate, ammonium sulfamate, ammonium tartarate, ammonium thioglycolate, 2,4,6-trinitrophenol ammonium, etc.

Of the ammonium compounds of the present invention, particularly preferred are ammonium thiosulfate, ammonia water (ammonium hydroxide), ammonium sulfate, ammonium chloride, ammonium nitrate, ammonium pentaborate, ammonium sulfamate, of which ammonium thiosulfate is most preferred.

The compound capable of releasing hydrogen ions to be used in the present invention may be added in an amount of $10^{-5}$ mole or more, preferably within the range of from 0.001 to 5.0 mole per liter of the water washing-substitutive stabilizing solution, more preferably from 0.002 to 1.0 mole.

The pH of the water washing-substitutive stabilizing solution is not particularly limited, but preferably within the range of from pH 2.0 to 9.5, more preferably from pH 4.0 to 9.0, particularly from 6.0 to 9.0.

The pH controller which can be contained in the water washing-substitutive stabilizing solution of the present invention may be any alkali agent or acid agent generally known in the art. The compound capable of releasing hydrogen ions after processing may prefeably adjust the pH of the emulsion film surface of the light-sensitive material at a pH within the range of from 3 to 8, more preferably from 3.2 to 6.8, most preferably from 3.7 to 6.0, by changing its amount depending on the pH value and the buffering ability of the water washing-substitutive stabilizing solution.

The above pH of the emulsion film surface refers to the common logarithm of the reciprocal of the hydrogen ion mole concentration under the state where the dye containing layer of the light-sensitive material is swelled with a small amount of pure water, and said pH is measured according to the method by use of a conventional pH meter with a glass electrode, using a calomel electrode as the reference electrode. For measurement of the minimum surface coating pH with pure water, a flat type composite one electrode is generally employed.

Further, in the present invention, the water washing-substitutive stabilizing solution should preferably contain a chelating agent with a chelate stability constant for iron ions of 8 or more, for the objects of the present invention.

The chelate stability constant as mentioned herein means the constant generally known as from L. G. Sillen, A. E. Martell "Stability Constants of Metali-ion Complexes", The Chemical Society, London (1964); S. Chaberek, A. E. Martell "Organic Sequestering Agents", Wiley (1959).

As the chelating agents with stability constants of 8 or more for iron ions to be preferably used in the water washing-substitutive stabilizing solution, there may be included organic carboxylic acid chelating agents, organic phosphoric acid chelating agents, inorganic phosphoric acid chelating agents, polyhydroxy compounds, etc. Here, the above iron ions mean ferric ions ($Fe^{3+}$).

Specific, non-limitative exemplary compounds of the chelating agents with chelate stability constant with ferric ions of 8 or more include the following compounds. That is, there may be included, for example, ethylenediamine-di-o-hydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, diamonopropanoltetraacetic acid, trans-cyclohexanediaminetetraacetic acid, glycoletherdiaminetetraacetic acid, ethylenediamine tetrakismethylenephosphonic acid, nitrilotrimethylenephosphonic acid, 1-hydroxyethylidene-1,1'-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate, sodium hexametaphosphate and the like, particularly preferably diethylenetriaminepentaacetic acid, nitrilotriacetic acid, 1-hydroxyethylidene-1,1-diphosphonic acid or salts thereof. More preferably, ammonium salts of these may be employed.

The above chelating agent may be used in an amount of 0.01 to 50 g, preferably 0.05 to 20 g, per liter of the water washing-substitutive stabilizing solution, to give favorable results.

Other compounds to be added to the water washing-substitutive stabilizing solution than those as mentioned above may include organic acid salts (of citric acid, acetic acid, succinic acid, oxalic acid, benzoic acid, etc.), pH controllers (phosphate, borate, hydrochloric acid, sulfuric acid, etc.), antifungal agents (phenol derivatives, catechol derivatives, imidazole derivatives, triazole derivatives, thiabendazole derivatives, organic halide compounds, otherwise antifungal agents known as slime controlling agents in paper-pulp industries, etc.), or surfactants, preservatives, metal salts such as of Bi, Mg, Zn, Ni, Al, Sn, Ti, Zr, etc. These compounds may be used in any desired combination within the range which is necessary for maintaining the pH of the water washing-substitutive stabilizing solution according to the invention and does not affect deleteriously stability during storage of the color photographic image and generation of precipitates.

The light-sensitive material of the present invention should preferably contain a cyan coupler of the Formula (III) or (IV) shown below for storage stability of cyan dyes in dark places:

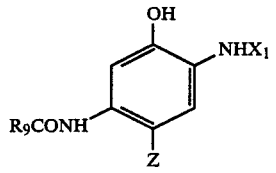

Formula (III)

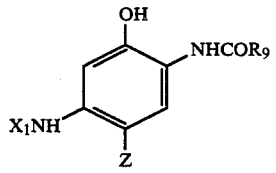

Formula (IV)

In the above Formulae, $X_1$ represents

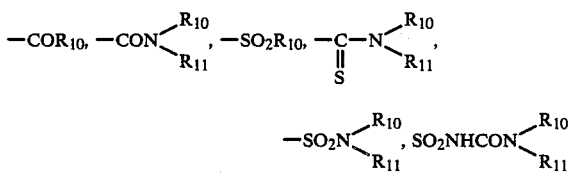

—$CONHCOR_{10}$ or —$CONHSO_2R_{10}$ ($R_{10}$ is an alkyl group, an alkenyl group, a cycloalkyl group, an aryl group or a hetero ring; $R_{11}$ is a hydrogen atoms, an alkyl group, an alkenyl group, a cycloalkyl group, an aryl group or a hetero ring; or $R_{10}$ and $R_{11}$ may be bonded to each other to form a 5- or 6-membered ring), $R_9$ represents a ballast group, Z represents a hydrogen atom or a group eliminable through coupling with the oxidized product of an atomatic primary amine color developing agent.
In the following, specific examples of the cyan coupler represented by the above Formulae (III), (IV) are enumerated.
(1)
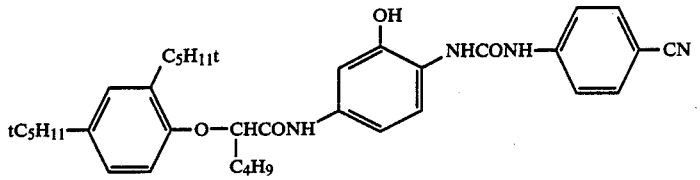
(2)
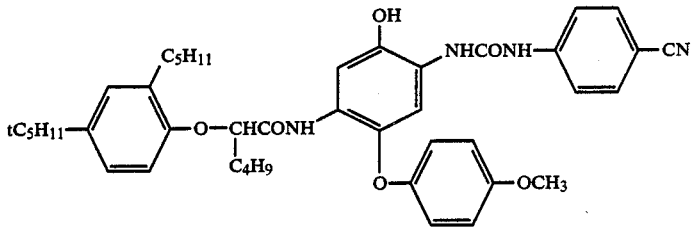
(3)
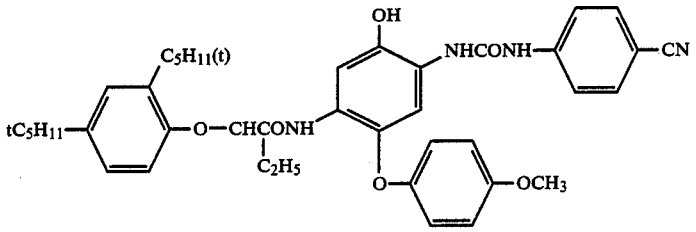
(4)
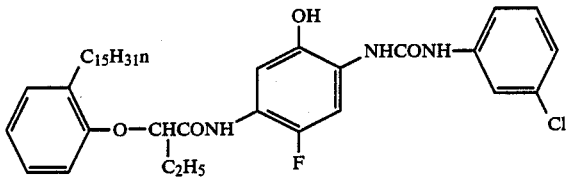
(5)
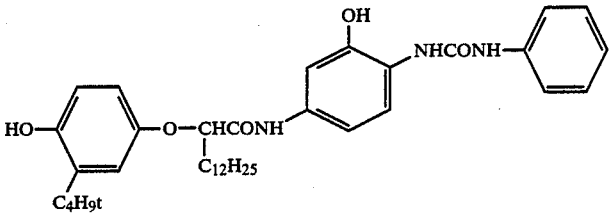
(6)
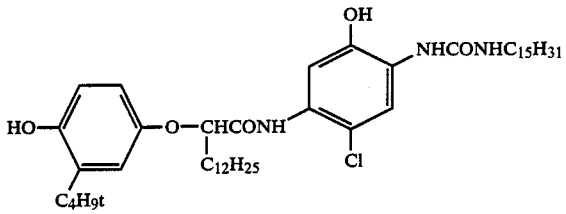
(7)
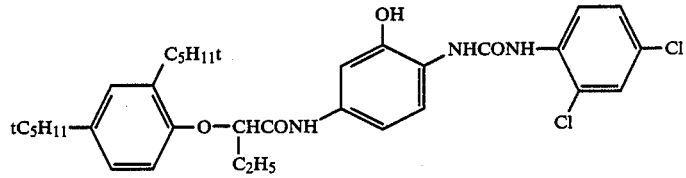

-continued
(8)
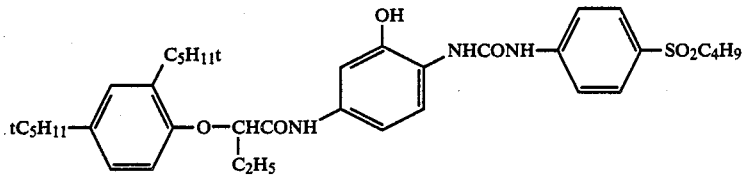
(9)
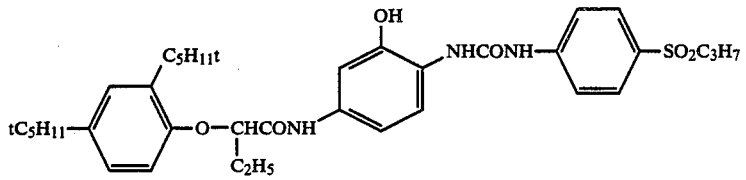
(10)
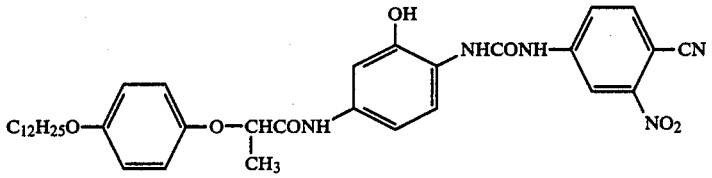
(11)
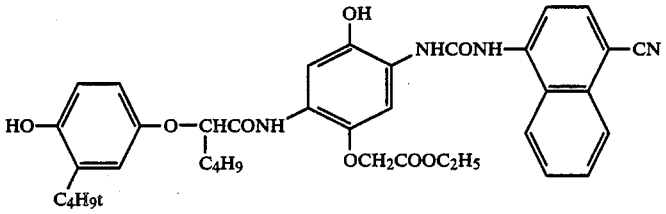
(12)
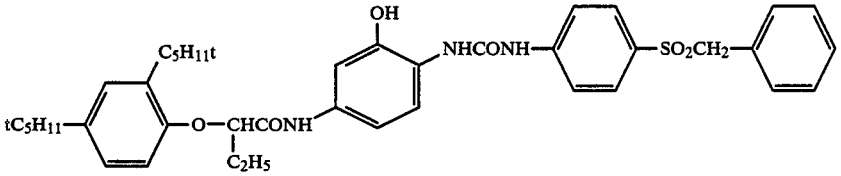
(13)
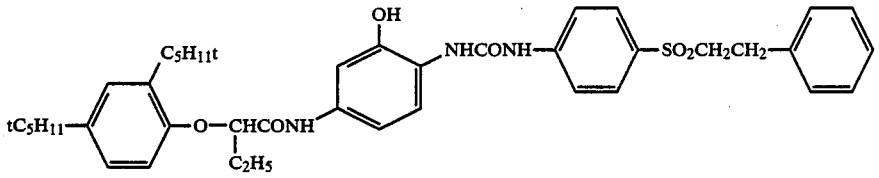
(14)
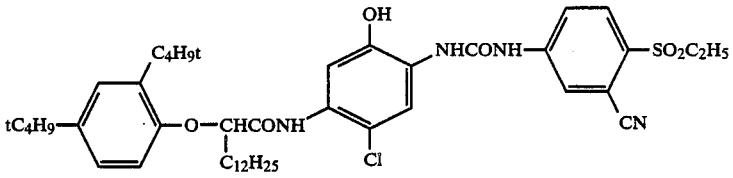
(15)
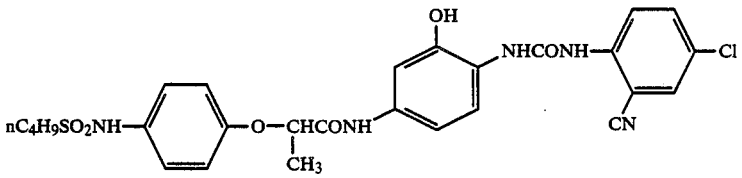

-continued
(16)
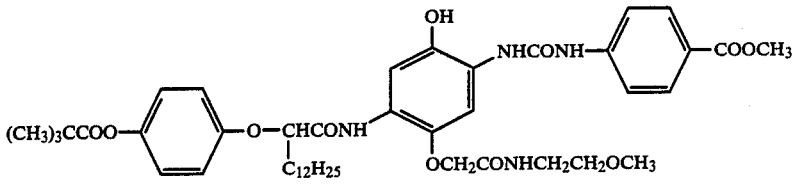
(17)
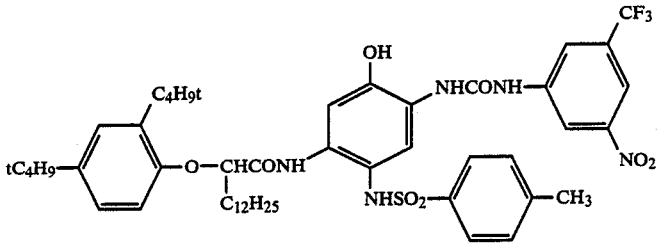
(18)
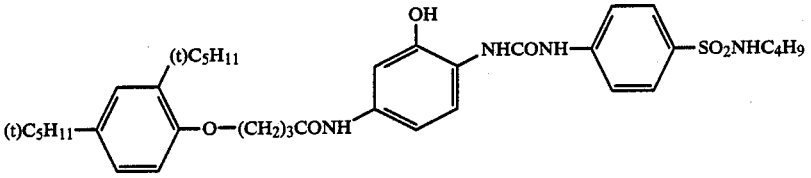
(19)
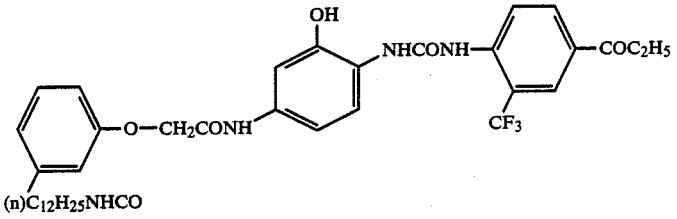
(20)
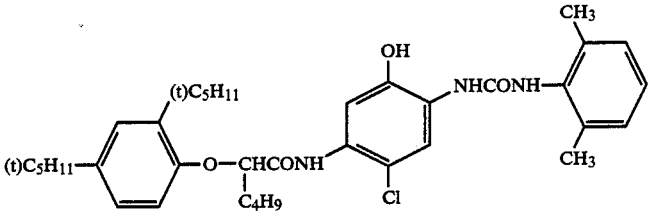
(21)
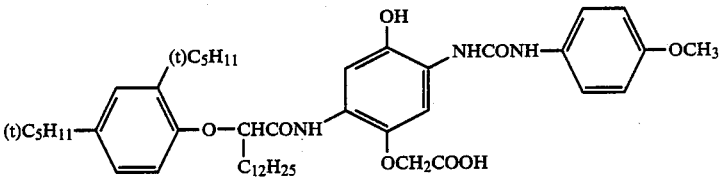
(22)
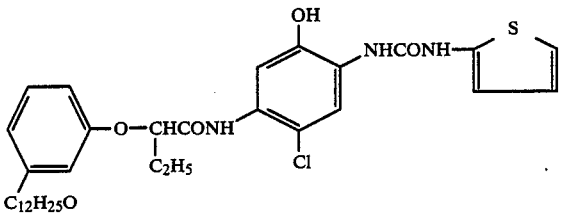

-continued
(23)
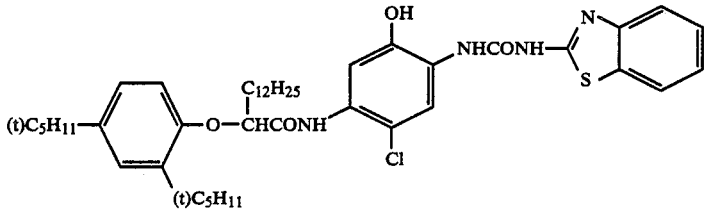
(24)
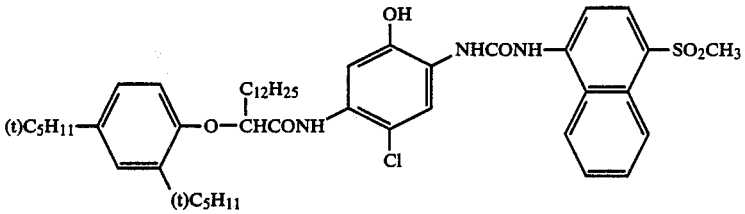
(25)
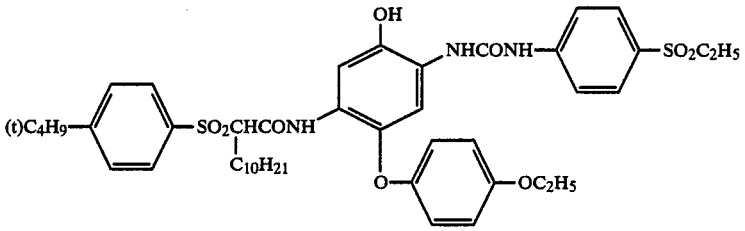
(26)
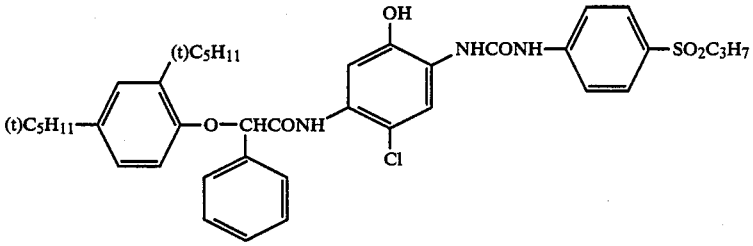
(27)
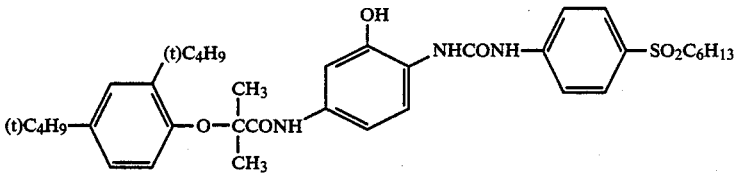
(28)
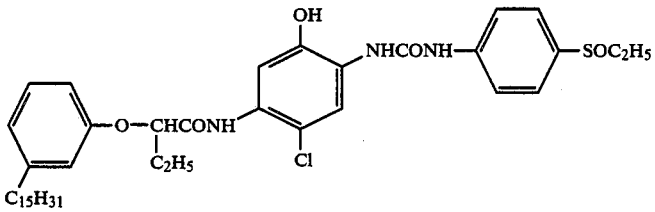
(29)
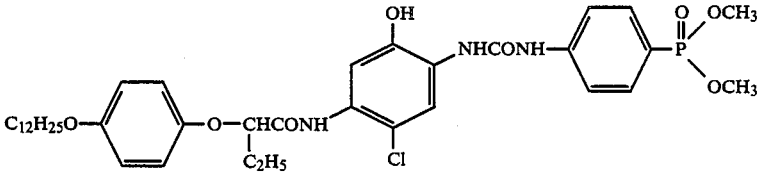

-continued
(30)
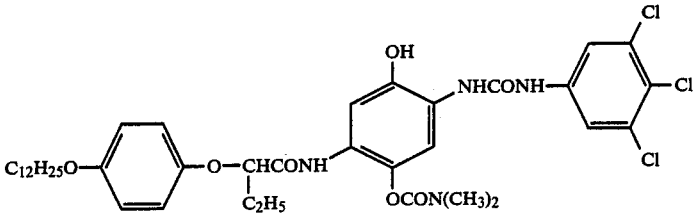
(31)
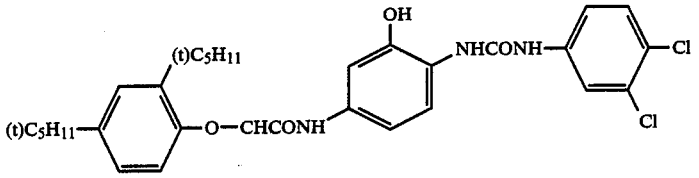
(32)
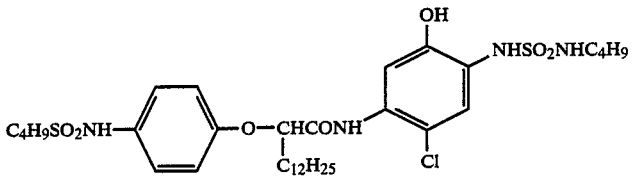
(33)
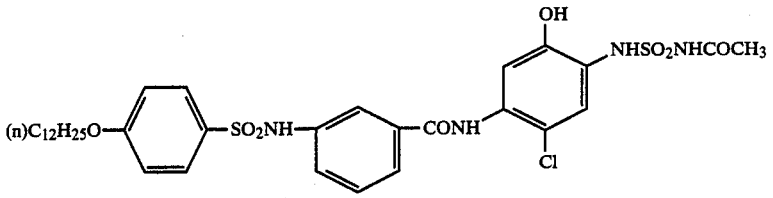
(34)
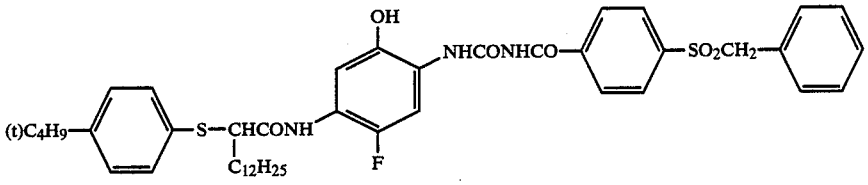
(35)
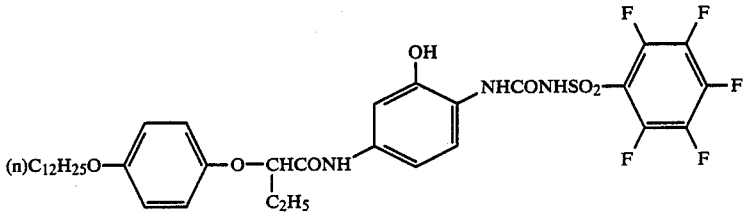
(36)
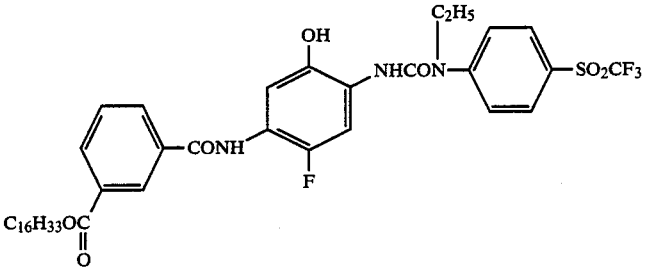

-continued
(37)
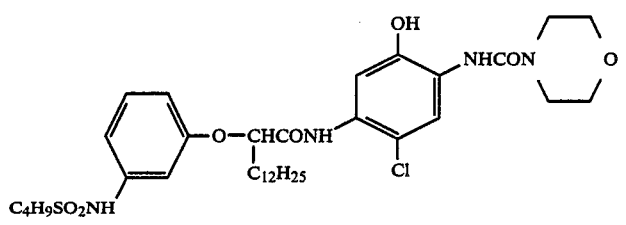
(38)
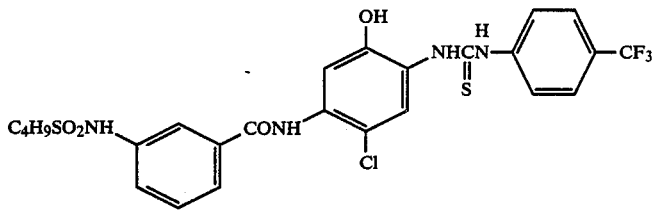
(39)
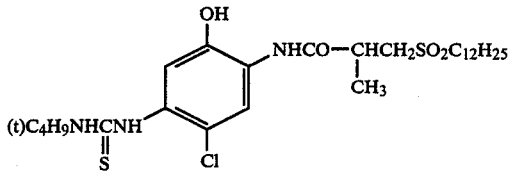
(40)
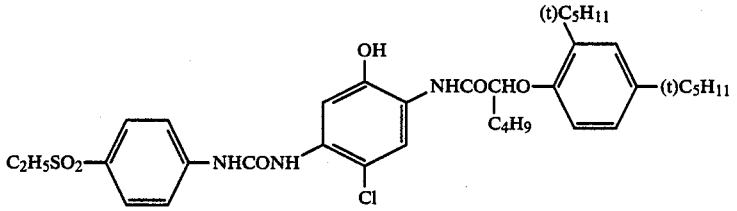
(41)
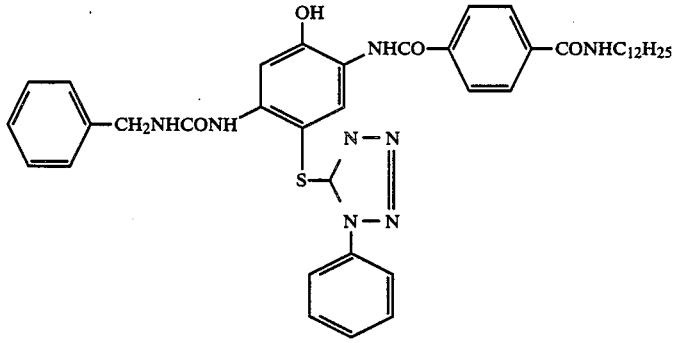
(42)
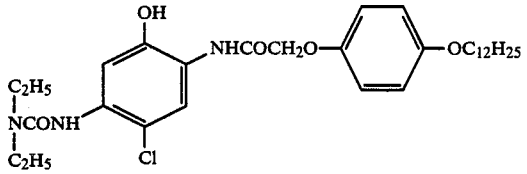
(43)
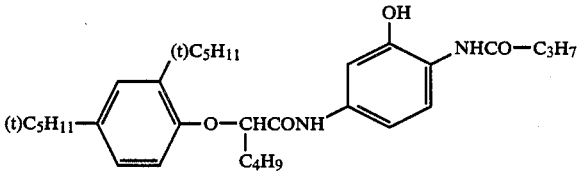

-continued
(44)
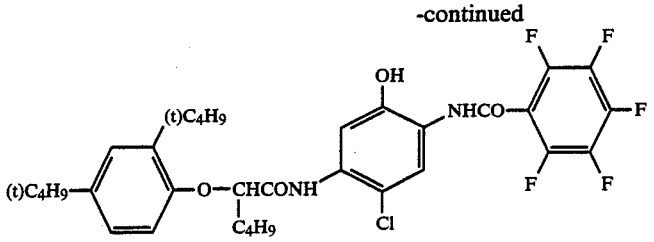
(45)
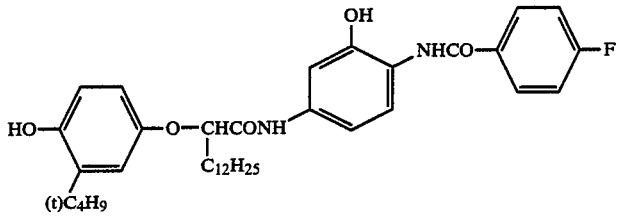
(46)
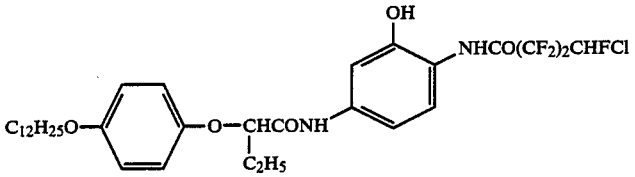
(47)
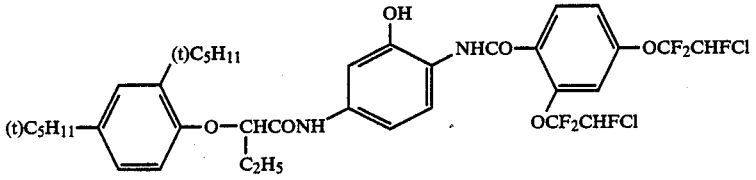
(48)
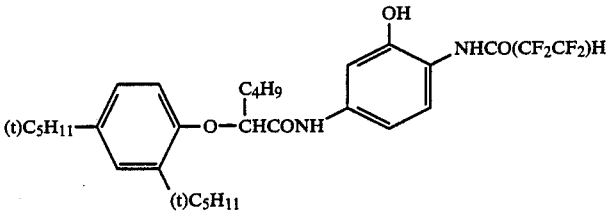
(49)
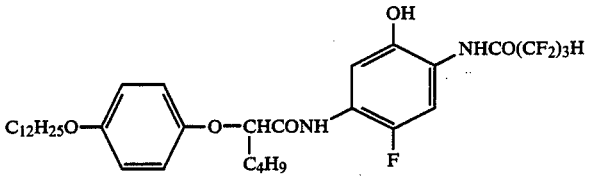
(50)
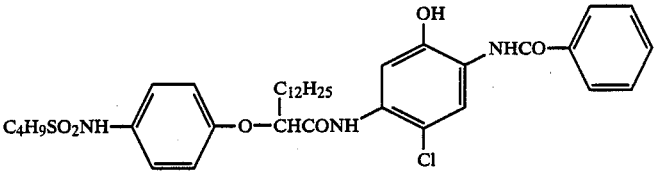
(51)
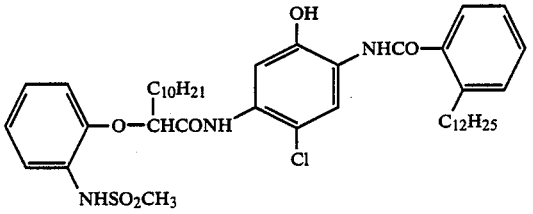

-continued
(52)
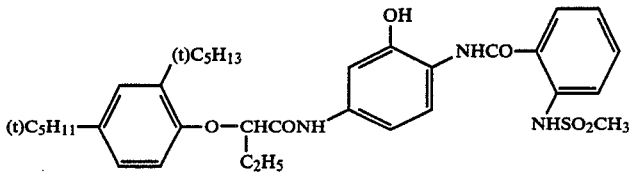
(53)
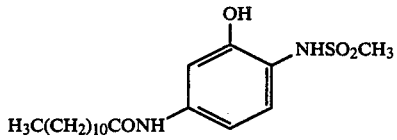
(54)
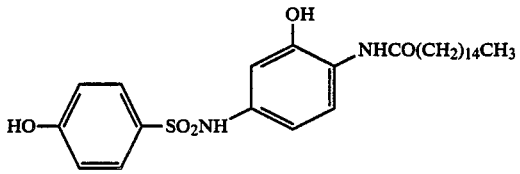
(55)
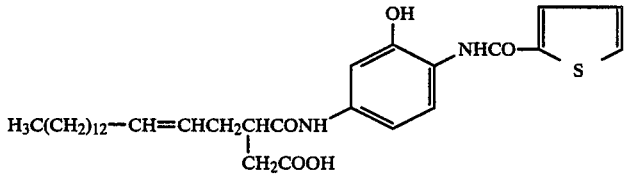
(56)
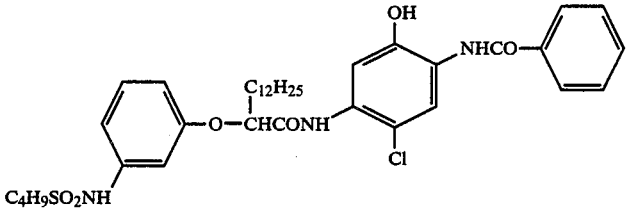
(57)
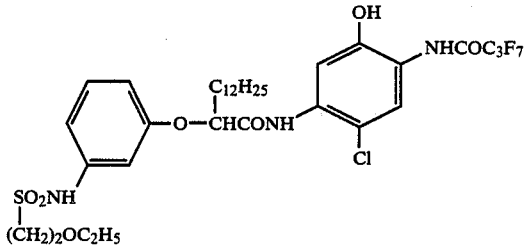
(58)
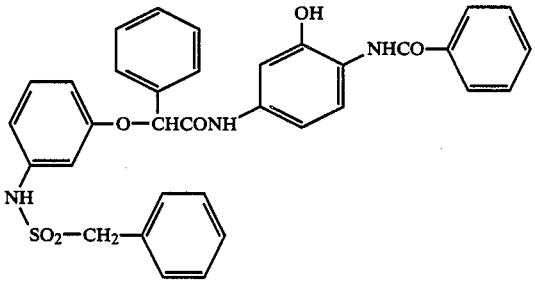

-continued
(59)
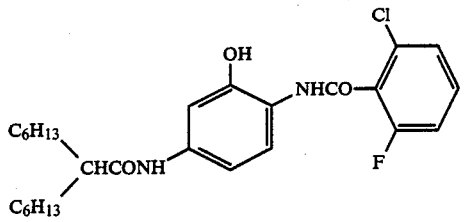
(60)
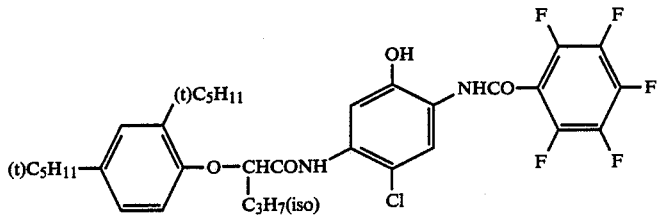
(61)
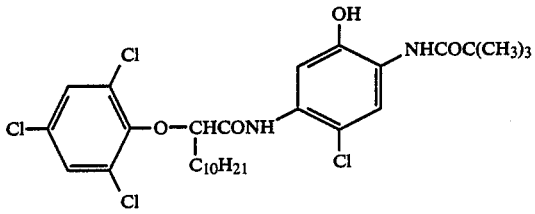
(62)
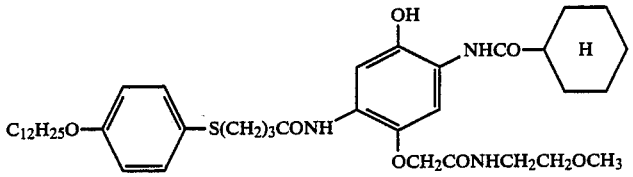
(63)
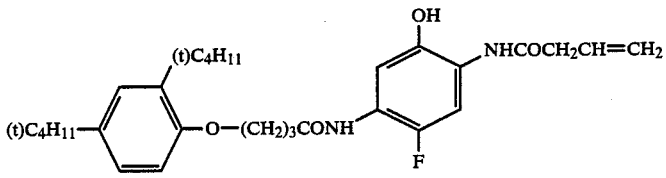
(64)
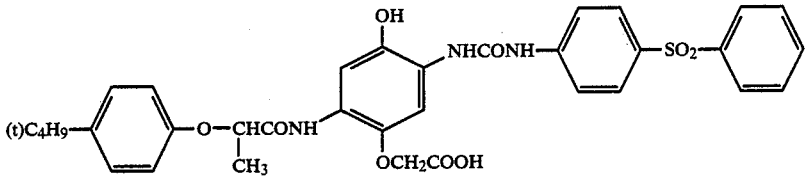
(65)
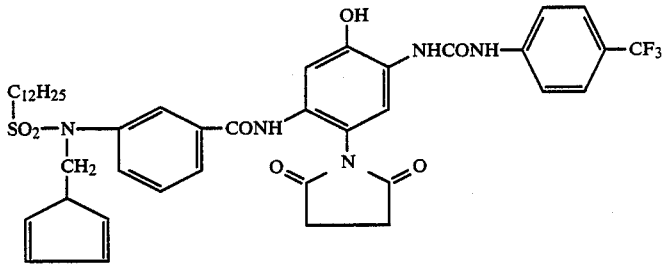
(66)
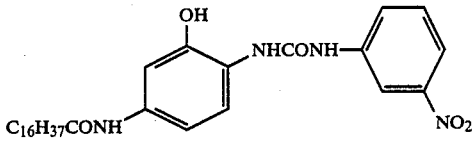

-continued (67)

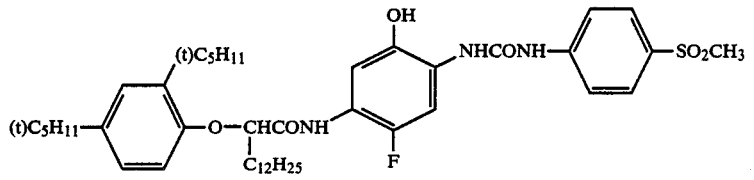

(68)

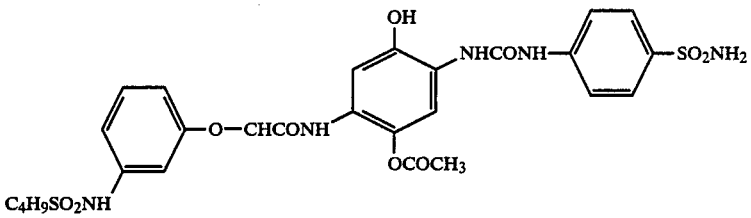

(69)

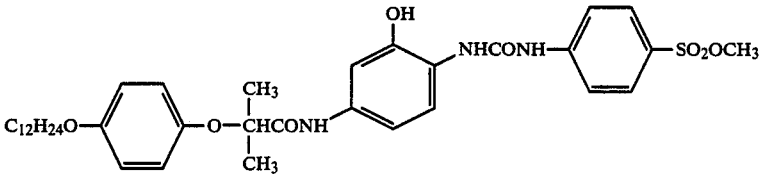

(70)

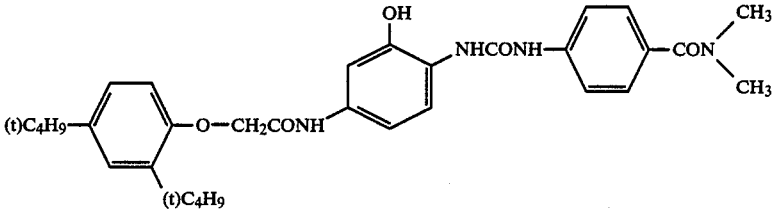

(71)

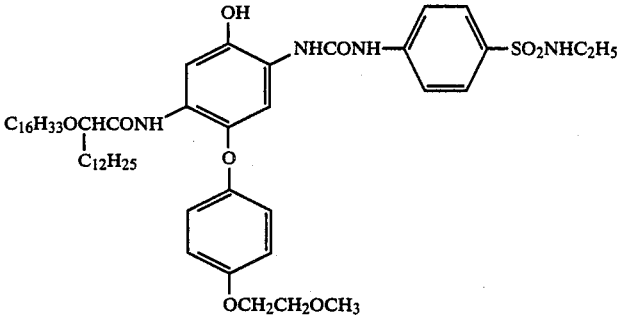

(72)

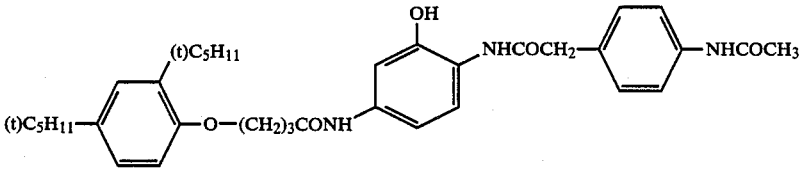

These cyan couplers can be prepared according to known methods, for example, preparing methods disclosed in U.S. Pat. Nos. 2,772,162, 3,758,308, 3,880,661, 4,124,396 and 3,222,176, British Pat. Nos. 975,773, 8,011,693 and 8,011,694, Japanese Unexamined Publication Nos. 21139/1972, 112038/1975, 163537/1980, 29235/1981, 99341/1980, 116030/1981, 69329/1977, 55945/1981, 80045/1981, 134644/1975, British Pat. No. 1,011,940, U.S. Pat. Nos. 3,446,622 and 3,996,253, Japanese Unexamined Patent Publication Nos. 65134/1981, 204543/1982, 204544/1982, 204545/1982 and Japanese Patent Application Nos. 131312/1981, 131313/1981, 131314/1981, 131309/1981, 131311/1981, 149791/1982 and 130459/1981.

Examples of the cyan couplers and others to be preferably used in the light-sensitive material of the present invention may include the exemplary compounds as disclosed in Japanese Patent Application No. 57903/1983 filed by the present Applicant.

Further, in the light-sensitive material of the present invention it is most preferred to use a cyan coupler represented by the Formula (V) shown below:

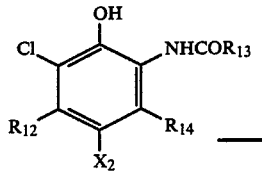

In the Formula, one of $R_{12}$ and $R_{14}$ is hydrogen, the other represents a straight or branched alkyl group having 2 to 12 carbon atoms, $X_2$ represents a hydrogen atom or a group eliminable through coupling reaction, and $R_{13}$ represents a ballast group.

In the following, specific examples of the cyan coupler represented by the Formula (V) are shown. Other exemplary compounds than those shown in the Table below include exemplary compounds (7) to (23) disclosed in Japanese Patent Application No. 95613/1984 filed by the present Applicant.

(Exemplary compound)

| Coupler No. | $R_{12}$ | $X_2$ | $R_{13}$ | $R_{14}$ |
|---|---|---|---|---|
| (73) | $-C_2H_5$ | $-Cl$ | 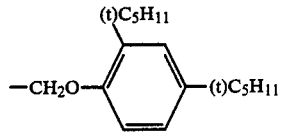 | $-H$ |
| (74) | $-C_2H_5$ | 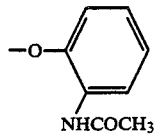 | 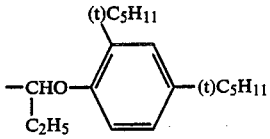 | $-H$ |
| (75) | $-CH(CH_3)_2$ | $-Cl$ | 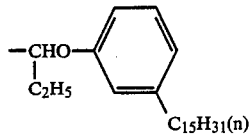 | $-H$ |
| (76) | $-C_2H_5$ | $-Cl$ | 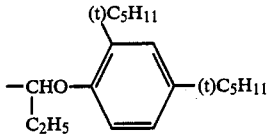 | $-H$ |
| (77) | $-C_2H_5$ | $-Cl$ | 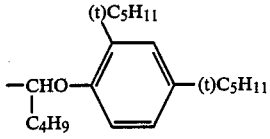 | $-H$ |
| (78) | $-C_4H_9$ | $-F$ | 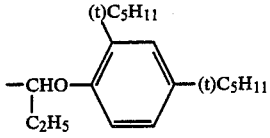 | $-H$ |
| (79) | $-C_2H_5$ | $-Cl$ | 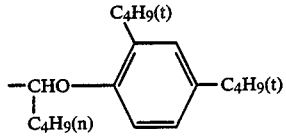 | $-H$ |
| (80) | $-C_2H_5$ | $-H$ | 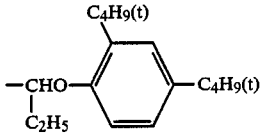 | $-H$ |

The silver halide emulsion which can be used in the present invention may be any of silver halide such as silver chloride, silver bromide, silver iodide, silver chlorobromide, silver chloroiodide, silver iodobromide, silver chloroiodobromide, etc. As the protective colloid for the silver halide, in addition to natural products such as gelatin, various synthetic products may be used. The silver halide emulsion may also contain conventional additives for photography such as stabilizers, sensitizers, film hardeners, sensitizing dyes, surfactants, etc.

The support may be any material such as polyethylene-coated paper, triacetate film, polyethyleneterephthalate film, white polyethyleneterephthalate film, etc.

The aromatic primary amine color developing agent to be used in the color developing solution for the light-sensitive material of the present invention may include known compounds which are widely used in various color photographic processes. These developing agents include aminophenol tupe and p-phenylenediamine type derivatives. These compounds may be used in the form of salts, for example, hydrochlorides or sulfates, which are more stable than free form. Also, these compounds may be used generally in an amount of about 0.1 g to about 3.0 g per liter of color developing solution, preferably about 1 g to about 1.5 g per liter of the color developing solution.

The aminophenol type developer may include, for example, o-aminophenol, p-aminophenol, 5-amino-2-oxytoluene, 2-amino-3-oxytoluene, 2-oxy-3-amino-1,4-dimethylbenzene and the like.

Particularly useful primary aromatic amino type color developers are N,N'-dialkyl-p-phenylenediamine type compounds, in which the alkyl group and the phenyl group may be substituted with any desired substituent. Among them, examples of particularly useful compounds are N,N'-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluenesulfonate.

The color developing solution can further contain, in addition to the above primary aromatic amine type color developer, various components conventionally added in color developing solutions, including alkali agents such as sodium hydroxide, sodium carbonate, potassium carbonate, etc.; alkali metal sulfites; alkali metal bisulfites; alkali metal thiocyanates; alkali metal halides; benzyl alcohol; water softeners and thickening agents, etc., as desired. The pH value of the color developing solution is usually 7 or higher, most generally about 10 to about 13.

The fixing solution to be used in the present invention may contain as the fixing agent, for example, thiosulfates (disclosed in Japanese Unexamined Patent Publication No. 185435/1982), thiocyanates (disclosed in U.K. Pat. No. 565135, Japanese Unexamined Patent Publication No. 137143/1979), halides (disclosed in Japanese Unexamined Patent Publication No. 130639/1977), thioethers (disclosed in Belgian Pat. No. 626970), thioureas (disclosed in U.K. Pat. No. 1189416), etc. Among these fixing agents, those on which the effect of the present invention can effectively act are thiosulfates. Also, when the processing solution having fixing ability is a bleach-fixing solution, organic ferric complexes may be available as the bleaching agent (disclosed in Japanese Patent Publication No. 38895/1979, Japanese Patent Publication (Tokuhyosho) No. 500704/1980, Japanese Unexained Patent Publication Nos. 52748/1981 and 149358/1984).

Further, when the processing solution having fixing ability according to the present invention is a processing solution intended to fixing processing and bleaching step is conducted as the step prior thereto, any bleaching agent may be available, including red prussiate, iron hydrochloride (disclosed in U.K. Pat. No. 736881, Japanese Patent Publication No. 44424/1981), persulfate (disclosed in German Pat. No. 2141199), hydrogen peroxide (disclosed in Japanese Patent Publication Nos. 11617/1983, 11618/1983), organic acid ferric complexes (disclosed in Japanese Unexamined Patent Publication Nos. 70533/1982, 43452/1983 and Japanese Patent Application No. 40633/1983).

In the processing of the present invention, silver may be recovered according to the known method from the water washing-substitutive stabilizing solution, as a matter of course, and also from the processing solutions containing soluble silver complexes such as fixing solution and bleach-fixing solution. For example, it is possible to utilize effectively the electrodialytic method (disclosed in French Pat. No. 2,299,667), the precipitation method (disclosed in Japanese Unexamined Patent Publication No. 73037/1977, German Pat. No. 2,331,220), the ion-exchange method (disclosed in Japanese Unexamined Patent Publication No. 17114/1976, German Pat. No. 2,548,237) and the metal substitution method (disclosed in U.K. Pat. No. 1,353,805).

The processing method of the present invention is useful for processing of color nega paper, color posi paper, reversal color paper, color posi film, color nega film, color reversal film, color X-ray film, etc.

The present invention is described in detail below by referring to the following Examples, by which the embodiments of the present invention are not limited at all.

EXAMPLE 1

A polyethylene-coated paper support was coated successively from the support side with the respective layers as shown below to prepare a light-sensitive material.

The polyethylene-coated paper employed was prepared by forming a coating layer with a thickness of 0.035 mm on the surface of a pure paper with a weight of 170 g/m$^2$, by extrusion coating of a mixture of 200 parts by weight of a polyethylene having an average viscosity of 100,000 and a density of 0.95 and 20 parts of a poyethylene having an average molecular weight of 2,000 and a density of 0.80 to which 6.8% by weight of an anatase type titanium oxide was added, and by providing a coating layer with a thickness of 0.040 mm consisting only of a polyethylene on the back of the paper. After pre-treatment with corona discharging was applied on the polyethylene-coated surface of the support, the respective layers were successively coated thereon.

First layer:

A blue-sensitive silver halide emulsion layer comprising a silver chlorobromide emulsion containing 95 mole % of silver bromide, said emulsion containing 350 g of gelatin per 1 mole of silver halide; being sensitized with $2.5\times10^{-4}$ mole of a sensitizing dye (with the use of isopropyl alcohol as the solvent) having the Formula shown below per mole of the silver halide:

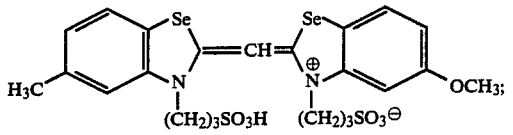

and containing 2,5-di-t-butylhydroquinone dispersed as a solution in dibutylphthalate and $2\times10^{-1}$ mole per mole of the silver halide of β-(4-(1-benzyl-2-phenyl-3,5-dioxo-1,2,4-triazolidy))-α-pivalyl-2-chloro-5-(γ-(2,4-di-t-amylphenoxy)butylamido)acetanilide as the yellow coupler, which emulsion is applied so as to give a silver quantity of 330 mg/m².

Second layer:

A gelatin layer containing 300 mg/m² of di-t-octylhydroquinone dispersed as a solution in dibutylphthalate, 200 mg/m² of a mixture of 2-(2'-hydroxy-3',5-di-t-butylphenyl)benzotriazole, 2-(2'-hydroxy-5'-t-butylphenyl)-benzotriazole, 2'-(2-hydroxy-3'-t-butyl-5'-methylphenyl)-5-chlorobenzotriazole and 2-(2'-hydroxy-3,5-di-t-butylphenyl)-5-chloro-benzotriazole as the UV-ray absorber, which emulsion is applied so as to give a gelatin content of 2000 mg/m².

Third layer:

A green-sensitive silver halide emulsion layer comprising a silver chlorobromide emulsion containing 85 mole % of silver bromide, said emulsion containing 450 g of gelatin per mole of the silver halide; being sensitized with $2.5\times10^{-4}$ mole of a sensitizing dye having the Formula shown below per mole of the silver halide:

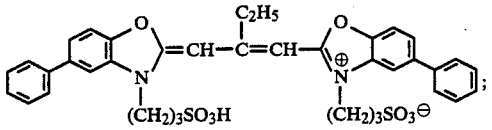

and containing 2,5-di-t-butylhydroquinone dissolved in a solvent comprising dibutylphthalate and tricresyl phosphate (2:1) and $1.5\times10^{-1}$ mole per mole of the silver halide of 1-(2,4,6-trichlorophenyl)-3-(2-chloro-5-octadecenylsuccinimidoanilino)-5-pyrazolone as the magenta coupler, which emulsion is applied so as to give a silver quantity of 300 mg/m². As the antioxidant, 0.3 mole of 2,2,4-tri-methyl-6-lauryloxy-7-t-octylchroman was used per mole of the coupler.

Fourth layer:

A gelatin layer containing 30 mg/m² of di-t-octylhydroquinone dispersed as a solution in dibutylphthalate, 500 mg/m² of a mixture of 2-(2'-hydroxy-3',5'-t-butylphenyl)benzotriazole, 2-(2-hydroxy-5''-t-butylphenyl)-benzotriazole, 2-(2'-hydroxy-3'-t-butyl-5'-methylphenyl)-5-chlorobenzotriazole and 2-(2'-hydroxy-3',5'-t-butylphenyl)-5-chloro-benzotriazole (2:1.5:1.5:2) as the UV-ray absorber, which emulsion is applied so as to give a gelatin content of 2000 mg/m².

Fifth layer:

A red-sensitive silver halide emulsion layer comprising a silver chlorobromide emulsion containing 85 mole % of silver bromide, said emulsion containing 500 g of gelatin per mole of the silver halide; being sensitized with $2.5\times10^{-4}$ mole of a sensitizing dye having the Formula shown below per mole of the silver halide:

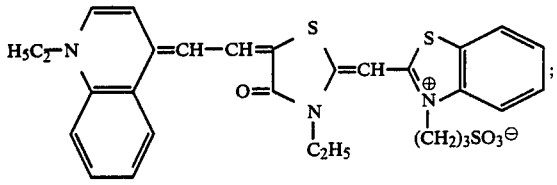

and containing 2,5-t-butylhydroquinone dispersed as a solution in dibutyl phthalate and $3.5\times10^{-1}$ mole per mole of the silver halide of an equimolar mixture of the Exemplary cyan couplers (1) and (21) as the cyan coupler, which emulsion is applied so as to give a silver quantity of 300 mg/m².

Sixth layer:

A gelatin layer applied so as to give a gelatin content of 1,000 mg/m².

The silver halide emulsions used in the respective light-sensitive emulsion layers (Layers 1, 3 and 5) were prepared according to the method as described in Japanese Patent Publication No. 7772/1971, each being chemically sensitized with the use of sodium thiosulfate pentahydrate, and 4-hydroxy-6-methyl-1,3,3a,7-tetrazaindene as the stabilizer, bis(vinylsulfonylmethyl)ether as the film hardener and saponin as the coating aid were incorporated in each emulsion.

After the color paper prepared according to the above method was exposed, continuous processings were carried out by use of the following processing steps and processing solution.

| (Processing steps) | | |
|---|---|---|
| (1) Color developing | 38° C. | 3 min. 30 sec. |
| (2) Bleach-fixing | 33° C. | 1 min. 30 sec. |
| (3) Stabilizing processing | 25–30° C. | 3 min. |
| (4) Drying | 75–100° C. | ca. 2 min. |

processing solution compositions:

| <Color developing tank solution> | |
|---|---|
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 30.0 g |
| 3-Methyl-4-amino-N—ethyl-N—(β-methanesulfonamidoethyl)-aniline sulfate | 5.5 g |
| Fluorescent whitening agent (4,4'-diaminostilbendisulfonic acid derivative, Trade name: Kaycoll PK-conc, manufactured by Shinnisso Kako Co. Ltd.) | 1.0 g |
| Hydroxylamine sulfate | 3.0 g |
| 1-Hydroxyethylidene-1,1-diphosohonic acid | 0.4 g |
| Hydroxyethyliminodiacetic acid | 5.0 g |
| Magnesium chloride hexahydrate | 0.7 g |
| 1,2-dihydroxybenzene-3,5-disulfonic acid disodium salt | 0.2 g |
| (made up to total quantity of one liter with addition of water and adjusted to pH 10.20 with KOH and $H_2SO_4$). | |

| <Color developing supplemental solution> | |
|---|---|
| Benzyl alcohol | 20.0 ml |
| Ethylene glycol | 5.0 ml |
| Potassium sulfite | 3.0 g |
| Potassium carbonate | 30.0 g |

-continued

| <Color developing supplemental solution> | |
|---|---|
| Hydroxylamine sulfate | 4.0 g |
| 3-Methyl-4-amino-N—ethyl-N—(β-methanesulfonamidoethyl)-aniline sulfate | 7.5 g |
| Fluorescent whitening agent (4,4'-diaminostilbendisulfonic acid derivative, Trade name: Kaycoll PK-conc, manufactured by Shinnisso Kako Co. Ltd.) | 2.5 g |
| 1-Hydroxyethylidene-1,1-diphosohonic acid | 0.5 g |
| Hydroxyethyliminodiacetic acid | 5.0 g |
| Magnesium chloride hexahydrate | 0.8 g |
| 1,2-dihydroxybenzene-3,5-disulfonic acid disodium salt | 0.3 g |
| (made up to total quantity of one liter with addition of water and adjusted to pH 10.70 with KOH). | |

| <Bleach-fixing tank solution> | |
|---|---|
| Ferric ammonium ethylenediaminetetra-acetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| (adjusted to pH 7.1 with potassium carbonate or glacial acetic acid, simultaneously with make-up to total quantity of one liter with addition of water). | |

| <Bleach-fixing supplemental solution A> | |
|---|---|
| Ferric ammonium ethylenediaminetetra-acetate dihydrate | 260 g |
| Potassium carbonate | 42 g |
| (made up to total quantity of one liter with addition of water; pH of this solution is 6.7 + 0.1). | |

| <Bleach-fixing supplemental solution B> | |
|---|---|
| Ammonium thiosulfate (70% solution) | 500 ml |
| Ammonium sulfite (40% solution) | 250 ml |
| Ethylenediaminetetraacetic acid | 17 g |
| Glacial acetic acid | 85 ml |
| (made up to total quantity of one liter; pH of this solution is 5.3 + 0.1). | |

| <Water washing-substitutive stabilizing solution and supplemental solution> | |
|---|---|
| 5-Chloro-2-methyl-4-isothiazoline-3-one | 0.02 g |
| 2-Methyl-4-isothizaoline-3-one | 0.02 g |
| Ethylene glycol | 1.0 g |
| 2-Octyl-4-isothiazoline-3-one | 0.01 g |
| Ammonium 1-Hydroxyethylidene-1,1-disulfonate (45% aqueous solution) | 3.0 g |
| $BiCl_3$ (45% aqueous solution) | 0.65 g |

-continued

| <Water washing-substitutive stabilizing solution and supplemental solution> | |
|---|---|
| $MgSO_4 7H_2O$ | 0.2 g |
| Aqueous ammonia solution (aqueous 25% ammonium hydroxide solution) | 2.5 g |
| (made up to one liter with water and adjusted to pH 7.0 with sulfuric acid). | |

An automatic processing machine was supplied in full with the above color developing tank solution, the bleach-fixing tank solution and the water washing-substitutive stabilizing solution, and running test was carried out for the above color paper subjected to processing while supplementing the color developing supplemental solution, the bleach-fixing supplemental solutions A and B as described above and water washing-substitutive supplemental stabilizing solution through quantitating cups at intervals of 3 minutes. The amounts supplemented per 1 $m^2$ of the color paper were 190 ml to the color developing tank, each 50 ml of the bleach-fixing supplemental solutions A and B to the bleach-fixing tank and 300 ml of supplemental solution for the water washing-substitutive stabilizing solution to the stabilizing tank, respectively.

The stabilizing processing tanks in the automatic processing machine were assembled in a multi-stage countercurrent system, in which the first to the third tanks were arranged in the direction of the flow of the light-sensitive material, supplement being done through the third tank, with the overflow from the third tank being permitted to be flowed into the previous tank and further the overflowed liquor being permitted to be flowed into the further previous tank.

Continuous processing was performed until the total amount of the water washing-substitutive stabilizing solution became 3-fold of the total volume of the stabilizing tanks.

After continuous processing, 6 samples, each one liter, of the water washing-substitutive stabilizing solutions in the first tank to the third tank were taken out, respectively, and to each sample was added the compound as shown in Table 1, followed by adjustment to pH 7.5 with $H_2SO_4$ and KOH. By use of the above processing steps and processing solutions, processing of the above light-sensitive material was conducted after exposure so as to give a cyan dye density of 1.5, and the material was stored in a humidistat and thermostat tank of 75° C. and 90% RH for 15 days, followed by measurement of the cyan dye density before and after storage with red light by means of an optical densitometer (PDA-65, produced by Konishiroku Photo Industry Co.), from which the fading percentage of the cyan dye was calculated. The results are shown in Table 1.

TABLE 1

| Sample No. | Compound added | Amount added | Fading percentage of cyan dye (%) |
|---|---|---|---|
| 1 Comparative example | none | — | 39 |

TABLE 1-continued

| Sample No. | Compound added | Amount added | Fading percentage of cyan dye (%) |
|---|---|---|---|
| 2 Comparative example | 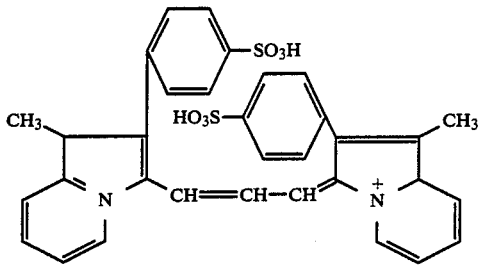 | 10 mg/l | 40 |
| 3 Comparative example | 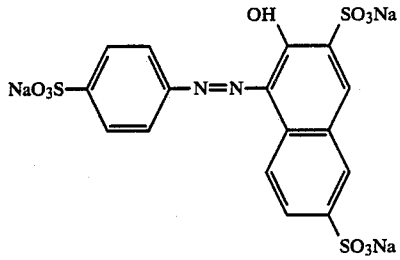 | 10 mg/l | 42 |
| 4 The invention | Exemplary compound (A-1) | 10 mg/l | 21 |
| 5 The invention | Exemplary compound (B-8) | 10 mg/l | 18 |
| 6 The invention | Exemplary compound (B-20) | 10 mg/l | 17 |

As is apparent from Table 1, while no effect for fading of the cyan dye is observed by addition of the known dyes for photography of Samples No. 2 and 3, addition of the present compound is very effective.

EXAMPLE 2

Using the method for preparation of light-sensitive material of Example 1, the Exemplary compound (B-20) of the present invention was incorporated in the red-sensitive emulsion (Fifth layer) in an amount of 30 mg per $m^2$ of the light-sensitive material. As Control, the Control dye shown below was incorporated in the light-sensitive material.

Control dye:

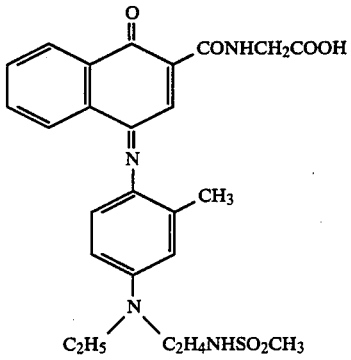

By use of the two kinds of dyes, continuous processing was conducted for each of them in the same manner as in Example 1 with the use of the processing steps and the processing solution as shown in Example 1. After continuous processing, each of the unexposed light-sensitive materials was processed to prepare a sample of white ground.

Both of the Exemplry compound (B-20) and the above Control dye are colored in cyan colors, and the light-sensitive material employing the Control dye has cyan stain generated on the white ground sample to a level of problem as observed with eyes. Whereas, the white ground sample of the light-sensitive material employing (B-20) of the present invention is free from any tint of cyan, to give very favorable result.

When the density of the cyan stain was measured by means of a reflective spectrophotometer at 620 mm, absorbance of the Control sample was 0.16, while the sample of the present invention was 0.13. Also, measurement of the light-sensitive material of Example 1 subjected to water washing processing gave the same value 0.13 as the present invention. Thus, it has been found that the sample of the present invention is not deteriorated in white ground also in terms of numerical value.

Further, for the improved effect of cyan dye fading, the light-sensitive material after processing was confirmed according to the same method as the experiment in Example 1. As a result, the present invention gave the same favorable result as in Example 1, as compared with the Control.

EXAMPLE 3

The same experiments as Example 2 were conducted except for using Exemplary compounds (C-3) and (D-8) in place of the Exemplary compound (B-20) used in Example 2.

As a result, the same very favorable results as in Example 2 were obtained without deterioration of white ground and very small fading of the cyan color.

EXAMPLE 4

By use of the method for preparation of the light-sensitive material of Example 1, the Exemplary compound (A-1) was incorporated to 30 mg per $m^2$ of the light-sensitive material in the red-sensitive emulsion (Fifth layer).

By using the light-sensitive material, the processing steps, the water washing-substitutive stabilizing solution and other processing solutions, continuous processing was carried out by varying only the amount supplemented of the water washing-substitutive stabilizing solution as shown in Table 2. Also, the same processing was conducted for the light-sensitive material of Example 1, and the same samples as in Example 2 were prepared for respective materials and the fading percentages of cyan dyes after 15 days under 75° C. and 90% RH were determined. The results are shown in Table 2.

TABLE 2

| Fading percentage of cyan dye | Amount supplemented ml/$m^2$ | | | | | |
|---|---|---|---|---|---|---|
| | 10 | 25 | 150 | 400 | 500 | 1000 |
| (A-1) Light-sensitive material containing the compound (the invention) | 41 | 25 | 21 | 20 | 22 | 31 |
| (A-1) none (Comparative example) | 68 | 50 | 45 | 39 | 38 | 37 |

From Table 2, it can be seen that the amount supplemented of the water washing-substitutive stabilizing solution is particularly preferably 25 to 500 ml/$m^2$ in the present invention.

EXAMPLE 5

For each of the light-sensitive materials containing the Examplary compound (B-20) and the Control dye of Example 2, the same continuous processing of Example 1 was conducted by use of the water washing-substitutive stabilizing solution as shown below and the processing steps and processing solutions of Example 1. Eight samples, each one liter, of the water washing-substitutive stabilizing solutions for in the first tank to the third tank after continuous processing were taken out, respectively. To the respective samples were added the compounds No. 7 to 14 shown in Table 3, followed by adjustment of pH with KOH and sulfuric acid. For each sample, after exposure, the light-sensitive material was processed in the same manner as in Example 1, and the fading percentage of the cyan dye after 15 days under 75° C. and 90% RH was determined. The results are shown in Table 3.

Stabilizing tank solution and supplemental solution as substitute for water washing:

| | |
|---|---|
| 1-Hydroxyethylidene-1,1-diphosphonic acid | 1.5 g |
| Zinc sulfate | 0.5 g |
| Hydroxybenzoic acid | 0.5 g |
| (made up to one liter with water). | |

TABLE 3

| | Compound added to water washing substitutive stabilizing solution | Amount added (g/l) | pH of solution | Fading percentage of cyan dye: Exemplary compound (B-20) | Fading percentage of cyan dye: Control dye |
|---|---|---|---|---|---|
| No. 7 | — | — | 7.0 | 32 | 46 |
| No. 8 | methylamin (aqueous 40% solution) | 4.0 | 7.0 | 27 | 42 |
| No. 9 | ammonium bromide | 4.0 | 7.0 | 23 | 42 |
| No. 10 | ammonium thiosulfate | 4.0 | 1.5 | 62 | 71 |
| No. 11 | ammonium thiosulfate | 4.0 | 3.0 | 27 | 48 |
| No. 12 | ammonium thiosulfate | 4.0 | 5.0 | 23 | 44 |
| No. 13 | ammonium thiosulfate | 4.0 | 7.8 | 18 | 42 |
| No. 14 | ammonium thiosulfate | 4.0 | 10.0 | 57 | 65 |

As can be seen from Table 3, it is preferable in the present invention to add a compound capable of releasing hydrogen ions after processing into the water washing-substitutive stabilizing solution, and to maintain the pH of the water washing-substitutive stabilizing solution at a value in the range of from 2.5 to 9.5.

We claim:

1. In a method of processing a light-sensitive silver halide color photographic material including development and fixing steps, the improvement comprising after fixing the light sensitive silver halide photographic material by processing the light-sensitive silver halide color photographic material with a processing solution having fixing ability; the step of processing the fixed material in the presence of at least one compound of the Formulae (I), (II), (II') and (II''), with a water washing-substitutive stabilizing solution substantially without carrying out washing with water, said at least one compound represented by the Formulae (I), (II), (II') and (II'') being shown below:

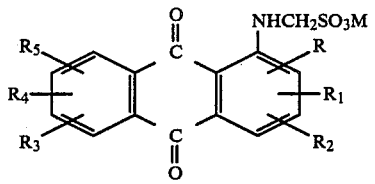

Formula (I)

wherein R, $R_1$, $R_2$, $R_3$, $R_4$ and $R_5$ each represent a hydrogen atom, a halogen atom, a hydroxy group, an alkyl group, an alkoxy group, a sulfo group or $-NHCH_2SO_3M$ (M represents a cation),

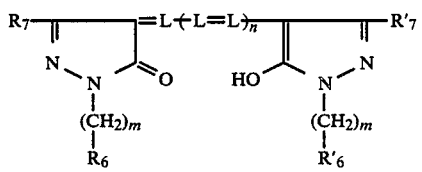

Formula (II)

wherein $R_6$ and $R_6'$ each represent a hydrogen atom, an unsubstituted alkyl group, a substituted alkyl group, an unsubstituted aryl group, a substituted aryl group, an unsubstituted heterocyclic group or a substituted heterocyclic group; $R_7$ and $R_7'$ each represent a hydroxy group, an alkoxy group, a substituted alkoxy group, a cyano group, a trifluoromethyl group, —$COOR_8$, —$CONHR_8$, —$NHCOR_8$, an amino group, a substituted amino group substituted with an alkyl group having 1 to 4 carbon atoms or a cyclic amino group represented by the Formula:

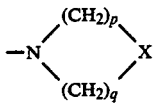

(wherein p and q each represent 1 or 2, and X represents an oxygen atom, a sulfur atom or a —$CH_2$— group); $R_8$ represents a hyrogen atom, an alkyl group or an aryl group; L represents a methyne group; n represents 0, 1 or 2; m represents 0 or 1, Formula (II')

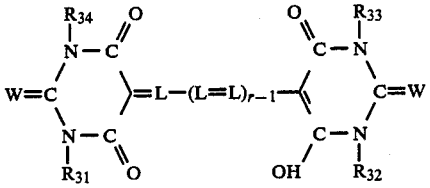

wherein r represents an integer of 1 to 3; W represents an oxygen atom or a sulfur atom; L represents a methyne group; $R_{31}$–$R_{34}$ each represent a hydrogen atom, an alkyl group, an aryl group, an aralkyl group or a heterocyclic group, at least one of which is a substituent other than hydrogen atom, Formula (II'')

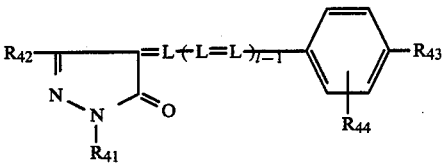

wherein l represents an integer of 1 or 2; L represents a methyne group; $R_{41}$ represents an alkyl group, an aryl group or a heterocyclic group; $R_{42}$ represents a hydroxy group, an alkyl group, an alkoxy group, a substituted alkoxy group, a cyano group, a trifluoromethyl group, —$COOR_8$, —$CONHR_8$, —$NHCOR_8$, an amino group, a substituted amino group substituted with an alkyl group having 1 to 4 carbon atoms or a cyclic amino group represented by the Formula:

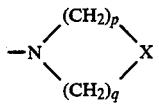

(wherein p and q each represent 1 or 2, and X represents an oxygen atom, a sulfur atom or a —$CH_2$— group); $R_8$ represents a hyrogen atom, an alkyl group or an aryl group; $R_{43}$ represents a —$OZ_1$ group or a

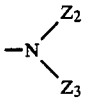

group; $Z_1$, $Z_2$ and $Z_3$ each represent a hydrogen atom or an alkyl group, $Z_2$ and $Z_3$ being either the same or different or alternatively being bonded to each other to form a ring; and $R_{44}$ represents a hydrogen atom, an alkyl group, a chlorine atom or an alkoxy group.

2. The method of processing a light-sensitive silver halide color photographic material according to claim 1, wherein R, $R_1$, $R_2$, $R_3$, $R_4$ and $R_5$ each represent a hydrogen atom, a hydroxy group, —$SO_3M$ or —$NHCH_2SO_3M$ (M represents an alkali metal ion); $R_6$ and $R_6'$ each represent an alkyl group or an aryl group; $R_7$ and $R_7'$ each represent an alkoxy group, a cyano group or —$COOR_8$; $R_8$ represents a hyrogen atom or an alkyl group having 1 to 4 carbon atoms; $R_{31}$ to $R_{34}$ each represent a hydrogen atom, an alkyl group or an aryl group; $R_{41}$ and $R_{42}$ each represent an alkyl group or an aryl group; $R_{43}$ represents

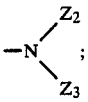

$R_{44}$ represents a hydrogen atom or an alkyl group.

3. The method of processing a light-sensitive silver halide color photographic material according to claim 2, wherein R, $R_1$, $R_2$ or $R_4$ each represent a hydrogen atom, a hydroxy group or —$SO_3M$ (M represents a sodium atom or a potassium ion); $R_3$ represents a hydrogen atom or —$NHCH_2SO_3M$ (M is defined as above); $R_5$ represents a hydroxy group or —$NHCH_2SO_3M$ (M is defined as above); $R_6$ and $R_6'$ each represent a phenyl group; $R_7$ and $R_7'$ each represent a cyano group or —$COOR_8$; $R_8$ represents a hyrogen atom or an alkyl group having 1 to 2 carbon atoms; $R_{31}$ to $R_{34}$ each represent an alkyl group having 1 to 4 carbon atoms or a phenyl group; $R_{41}$ and $R_{42}$ each represent a phenyl group; $R_{43}$ represents

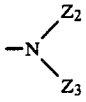

($Z_2$ and $Z_3$ each represent a hydrogen atom or an alkyl group having 1 to 2 carbon atoms); $R_{44}$ represents a hydrogen atom or an alkyl group having 1 to 2 carbon atoms.

4. The method of processing a light-sensitive silver halide color photographic material according to claim 1, wherein the amount of the water washing-substitutive stabilizing solution supplemented is within the range from 25 ml to 500 ml per 1 $m^2$ of the light-sensitive silver halide color photographic material being processed.

5. The method of processing a light-sensitive silver halide color photographic material according to claim 1, wherein the pH of the water washing-substitutive stabilizing solution is from 2 to 9.5

6. The method of processing a light-sensitive silver halide color photographic material according to claim 1, wherein the water washing-substitutive stabilizing solution contains a compound capable of releasing hydrogen ions after processing in an amount of $10^{-5}$ mole or more.

7. The method of processing a light-sensitive silver halide color photographic material according to claim 6, wherein the compound capable of releasing hydrogen ions after processing is ammonium thiosulfate.

8. The method of processing a light-sensitive silver halide color photographic material according to claim 1, wherein the compound represented by the Formula (I), (II), (II') or (II'') is incorporated in the light-sensitive silver halide color photographic material.

9. The method of processing a light-sensitive silver halide color photographic material according to claim 8, wherein the compound represented by the Formula (I), (II), (II') or (II'') is incorporated in the material by coating in an amount of 1 to 800 mg per $m^2$ of the material.

10. The method of processing a light-sensitive silver halide color photographic material according to claim 9, wherein the compound represented by the Formula (I), (II), (II') or (II'') is incorporated in the material by coating in an amount of 2 to 200 mg per $m^2$ of the material.

11. The method of processing a light-sensitive silver halide color photographic material according to claim 1, wherein the compound represented by the Formula (I), (II), (II') or (II'') is added into the water washing-substitutive stabilizing solution in an amount of 0.005 to 200 mg per one liter of the solution.

12. The method of processing a light-sensitive silver halide color photographic material according to claim 11, wherein the compound represented by the Formulae (I), (II), (II') or (II'') is added into the water washing-substitutive stabilizing solution in an amount of 0.01 to 50 mg per one liter of the solution.

13. The method of processing a light-sensitive silver halide color photographic material according to claim 2, wherein the amount of the water washing-substitutive stabilizing solution is supplemented within the range from 25 ml to 500 ml per 1 $m^2$ of the light-sensitive silver halide color photographic material being processed;

the pH of the water washing-substitutive stabilizing solution is within the range of from 2 to 9.5;

the water washing-substitutive stabilizing solution contains a compound capable of releasing hydrogen ions after processing in an amount of $10^{-5}$ mole or more; and the compound represented by the Formulae (I), (II), (II') of (II'') is incorporated in the material by coating in an amount of 1 to 800 mg per $m^2$ of the material.

14. The method of processing a light-sensitive silver halide color photographic material according to claim 2, wherein the amount of the water washing-substitutive stabilizing solution is supplemented within the range from 25 ml to 500 ml per 1 $m^2$ of the light-sensitive silver halide color photographic material being processed;

the pH of the water washing-substitutive stabilizing solution is within the range of from 2 to 9.5;

the water washing-substitutive stabilizing solution contains a compound capable of releasing hydrogen ions after processing in an amount of $10^{-5}$ mole or more; and the compound represented by the Formulae (I), (II), (II') or (II'') is added into the water washing-substitutive stabilizing solution in an amount of 0.005 to 200 mg per one liter of the solution.

15. The method of processing a light-sensitive silver halide color photographic material according to claim 3, wherein the amount of the water washing-substitutive stabilizing solution is supplemented within the range from 25 ml to 500 ml per 1 $m^2$ of the light-sensitive silver halide color photographic material being processed;

the pH of the water washing-substitutive stabilizing solution is within the range of from 4 to 9;

the water washing-substitutive stabilizing solution contains ammonium thiosulfate in an amount so that it may release hydrogen ions after processing in an amount of from 0.001 to 5 moles; and the compound represented by the Formulae (I), (II), (II') or (II'') is incorporated in the material by coating in an amount of 2 to 200 mg.

16. The method of processing a light-sensitive silver halide color photographic material according to claim 3, wherein the amount of the water washing-substitutive stabilizing solution is supplemented within the range from 25 ml to 500 ml per 1 $m^2$ of the light sensitive silver halide color photographic material being processed;

the pH of the water washing-substitutive stabilizing solution is within the range of from 4 to 9;

the water washing-substitutive stabilizing solution contains ammonium thiosulfate in an amount so that it may release hydrogen ions in an amount of from 0.001 to 5 moles; and the compound represented by the Formulae (I), (II), (II') or (II'') is added into the water washing-substitutive stabilizing solution in an amount of 0.01 to 50 mg per one liter of the solution.

17. The method of processing a light-sensitive silver halide color photographic material according to claim 15, wherein the pH of the water washing-substitutive stabilizing solution is from 6 to 9 and said solution contains ammonium thiosulfate sufficient to release hydrogen ions after processing in an amount of from 0.002 to 1 mole.

18. The method of processing a light-sensitive silver halide color photographic material according to claim 16, wherein the pH of the water washing-substitutive stabilizing solution is from 6 to 9 and said solution contains ammonium thiosulfate sufficient to release hydrogen ions after processing in an amount of from 0.002 to 1 mole.

* * * * *

UNITED STATES PATENT AND TRADEMARK OFFICE

CERTIFICATE OF CORRECTION

PATENT NO. : 4,746,598

DATED : May 24, 1988

INVENTOR(S) : Masayuki Kurematsu et al

It is certified that error appears in the above-identified patent and that said Letters Patent is hereby corrected as shown below:

In column 56, Claim 1 (line 10), "(II''')" should read --(II'')--.

Signed and Sealed this

Twentieth Day of November, 1990

*Attest:*

*Attesting Officer*

HARRY F. MANBECK, JR.

*Commissioner of Patents and Trademarks*